US008808594B1

(12) United States Patent
Marshall et al.

(10) Patent No.: US 8,808,594 B1
(45) Date of Patent: Aug. 19, 2014

(54) COFORM FIBROUS MATERIALS AND METHOD FOR MAKING SAME

(71) Applicants: Larry Marshall, Chesterfield, VA (US); Michael Bryner, Midlothian, VA (US); Gary Huvard, Chesterfield, VA (US)

(72) Inventors: Larry Marshall, Chesterfield, VA (US); Michael Bryner, Midlothian, VA (US); Gary Huvard, Chesterfield, VA (US)

(73) Assignee: Verdex Technologies, Inc., North Chesterfield, VA (US)

( * ) Notice: Subject to any disclaimer, the term of this patent is extended or adjusted under 35 U.S.C. 154(b) by 0 days.

(21) Appl. No.: 14/148,712

(22) Filed: Jan. 6, 2014

Related U.S. Application Data

(63) Continuation-in-part of application No. 13/912,187, filed on Jun. 6, 2013, now Pat. No. 8,668,854.

(60) Provisional application No. 61/802,643, filed on Mar. 16, 2013.

(51) Int. Cl.
*D01D 5/00* (2006.01)

(52) U.S. Cl.
USPC ..... 264/172.11; 264/103; 264/211.12; 264/211.14; 264/172.19; 264/210.8

(58) Field of Classification Search
None
See application file for complete search history.

(56) References Cited

U.S. PATENT DOCUMENTS

| | | | |
|---|---|---|---|
| 4,429,001 | A | 1/1984 | Kolpin et al. |
| 6,494,974 | B2 | 12/2002 | Riddell |
| 7,267,789 | B2 | 9/2007 | Chhabra et al. |
| 7,291,300 | B2 | 11/2007 | Chhabra et al. |
| 2003/0211802 | A1 | 11/2003 | Keck et al. |

*Primary Examiner* — Monica Huson
(74) *Attorney, Agent, or Firm* — Joham O. Brag; Innova Law, LLC

(57) ABSTRACT

A method is disclosed for producing a coform fibrous materials comprising the steps of supplying a first fiber forming stream comprising a first phase comprising a polymer melt and a second phase comprising a pressurized gas to a two-phase flow nozzle, supplying a separate second stream containing at least one secondary material to the two-phase flow nozzle, combining the first fiber forming stream and the second stream to form a composite fiber forming stream and fibrillating the composite fiber forming stream into a coform fibrous web. Superabsorbent and filtration coform fibrous materials for filtration and produced using the method are also disclosed.

7 Claims, 30 Drawing Sheets

VIEW B-B

VIEW B-B

VIEW A-A

COFORM FIBROUS MATERIALS AND METHOD FOR MAKING SAME

PRIOR APPLICATION

This application is the continuation in part of U.S. patent application Ser. No. 13/912,187, now U.S. Pat. No. 8,668,854, and also claims benefit to provisional U.S. patent application 61/802,643.

TECHNICAL FIELD

The disclosure relates to coform fibrous materials and process for making same

DESCRIPTION OF THE RELATED ART

Coform nonwoven webs or coform materials are known in the art and have been used in a wide variety of applications, including filters. The term "coform material" means a composite material containing a mixture or stabilized matrix of thermoplastic filaments and at least one additional material, often called the "second material" or "secondary material". Examples of the second material include, for example, absorbent fibrous organic materials such as woody and non-wood pulp from, for example, cotton, rayon, recycled paper, pulp fluff; superabsorbent materials such as superabsorbent particles and fibers; inorganic absorbent materials and treated polymeric staple fibers, and other materials such as non-absorbent staple fibers and non-absorbent particles and the like. Exemplary coform materials are disclosed in U.S. Pat. No. 5,350,624 to Georger et al.; U.S. Pat. No. 4,100,324 to Anderson et al.; U.S. Pat. No. 4,469,734 to Minto; and U.S. Pat. No. 4,818,464 to Lau et al.

U.S. Pat. No. 8,177,876 to Kalayci et al. discloses a fibrous web comprising a substantially continuous fiber mass and dispersed in the fiber a fiber spacer, spacer particulate or web separation means. The spacer or separation means causes the fiber web to attain a structure, in which the fiber mass or web portion, even though filled with particulate, has increased porosity, separated fibers or separated web portions within the structure, increased the depth of the fiber web without increasing the amount of polymer or the number of fibers within the web.

Groeger et al., U.S. Pat. No. 5,486,410, teach a fibrous structure typically made from a bicomponent, core/shell fiber, containing a particulate material. The particulate comprising an immobilized functional material held in the fiber structure. The functional material is designed to interact with and modify the fluid stream. Typical materials include silicas, zeolite, alumina, molecular sieves, etc. that can either react with or absorb materials in the fluid stream. Markell et al, U.S. Pat. No. 5,328,758, uses a melt blown thermoplastic web and a sorbtive material in the web for separation processing. Errede et al., U.S. Pat. No. 4,460,642, teach a composite sheet of PTFE that is water swellable and contains hydrophilic absorptive particles. This sheet is useful as a wound dressing, as a material for absorbing and removing non-aqueous solvents or as a separation chromatographic material. Kolpin et al., U.S. Pat. No. 4,429,001, teach a sorbent sheet comprising a melt blown fiber containing super absorbent polymer particles. Deodorizing or air purifying filters are shown in, for example, Mitsutoshi et al., JP 7265640 and Eiichiro et al., JP 10165731. While both surface loading and depth media have been used in the past and have obtained certain levels of performance, a substantial need remains in the industry for coform materials that can provide new and different performance characteristics than formerly obtained.

A major limitation of current coform material production processes is the difficulty in providing a homogeneous distribution of particulate matter between the fine fiber layers. Some areas of the various layers will still fuse on contact reducing porosity and thereby increasing the pressure drop. Additionally, the structural integrity of the nanofiber layers is degraded by the deposition process. Pliability and mechanical strength of the nanofiber layers is still limited and subject to tearing if stretched or compressed. Finally, current coform materials still require a separate substrate layer on which to deposit the nanofiber layer.

There is therefore a need for a monolithic coform material with uniform distribution of the secondary material throughout the fibrous web.

There is also a need for filtration materials combining strong particle capture properties with low pressure drop.

There is also a need for absorbent materials with high SAP load capacity and strike-through capabilities.

There is also a need for low-cost, coform materials produced at high line speeds using a wide range of polymers and particulates.

SUMMARY

The subject matter of the present disclosure is directed to the production of fine fibers of controllable fineness in a single step, high throughout process, and a novel two-phase flow nozzle device used for this purpose. Highly uniform materials comprised of nonwoven webs of fine fibers have been produced at commercial scale throughputs. Increased pore size materials combined with high surface area are also produced by the present disclosure. With the present disclosure, high quality, nanofibrous nonwoven products having improved thermal and liquid barrier properties, uniformity, loft, absorbency, resistance to compression and high surface area are provided that are suitable for a large variety of industrial and biomedical care fibrous products.

The present inventors have surprisingly found that nonwoven materials with high loft and uniformity, comprising a high proportion of fine fibers, can be produced without the use of organic solvents in a single step, highly scalable production process.

The disclosure is directed to an apparatus and method for forming fine fiber webs from polymer melts. The operative mechanism is to combine and mix both the fiber forming polymer melt and the working pressurized gas stream into a two phase flow within a spinning nozzle, upstream of the nozzle exit, and to pass this two phase flow through a long narrow channel of high length to width ratio, such that the polymer eventually forms a film on the walls of the channel. The film is thinned by the gas flow and is split into filaments at the nozzle exit.

A polymer melt heated and stirred to the desired spinning temperature and heated ambient air are pressurized and fed into a mixing means within the spin nozzle. There the polymer melt and the heated pressurized gas are mixed to create a two-phase flow. The multi-phase flow is then forced through a film forming channel exiting through an annular exit orifice. In one embodiment, the mixing means is a centrifugal two-phase chamber and the film forming channel is a converging conical geometry. The accelerating gas flow within the converging channel creates thin polymeric film layers on both sides of the converging channel. Upon exit from the nozzle the film layers are sheared into multi-fibrous strands of fibers with controllable fineness collected on a collector at a set distance from the tip of the nozzle.

One aspect of the inventive subject matter is to provide an apparatus and method for producing biocompatible non-woven fibrous webs without the use of organic solvents.

Another aspect of the inventive subject matter is to produce non-woven fibrous webs with fibers with a median diameter of less than 1 micron in economical and commercially viable quantities.

A further aspect of the inventive subject matter is to produce fine fiber webs with high loft and porosity for industrial and medical uses.

A further aspect of the present disclosure is to provide an apparatus and method for the production of uniform submicron fiber webs.

In yet another aspect, the disclosure provides a method and apparatus for producing a fibrous web of fine fibers which exhibits increased surface area, higher porosity and loft over that previously available and which does not pose the health concerns associated with fibers produced with organic solvents.

In a further aspect, the disclosure provides a method of making on nonwoven fibrous web, including the steps of:

a) supplying a first phase comprising a polymer melt and a second phase comprising a pressurized gas stream to a two-phase flow nozzle;
b) injecting the polymer melt and the pressurized gas stream into a mixing chamber within the two-phase flow nozzle wherein the mixing chamber combines the polymer flow and pressurized gas into a two-phase flow;
c) distributing the two-phase flow uniformly to a converging channel terminating into an channel exit wherein the converging channel accelerates the two-phase flow creating a polymeric film along the surface of the converging channel;
d) fibrillating the polymeric film at the channel exit of the converging channel in the form of a plurality of nanofibers.
e) collecting the fibers on a collector such as a screen or moving belt at a set distance of the spin nozzle exit orifice.

In another embodiment, a method for the production of a non-woven nanofibrous web from melted polymers comprises the steps of:

a) heating and stirring a polymer in a reactor vessel to a spinning temperature above the melting temperature the polymer;
b) feeding ambient air through a pressurization line to establish a head pressure on the melted polymer;
c) opening a valve forcing the melted and pressurized polymer out of the reactor vessel through the valve and then through a filter into a spin nozzle;
d) injecting a heated, pressurized gas through ports of a two-phase chamber of the spin nozzle into said two-phase chamber creating a rotational flow;
e) injecting the polymer into a mixing chamber through multiple orifices equally spaced around a cylindrical polymer feed tube;
f) forcing the two-phase air-polymer flow through a converging channel;
g) creating polymeric film layers on both sides of the converging channel;
h) shearing the polymeric film layers into fibers wherein the fiber fineness corresponds to the thickness of the polymeric film layers;
i) collecting the fibers on a screen or moving belt at a set distance of the spin nozzle exit orifice.

In an additional aspect, the disclosure provides a method and apparatus for producing a non-woven fibrous web with high uniformity, high porosity, large pore size and high surface area.

In various exemplary embodiments, the two-phase nozzle, apparatus, and method of the present disclosure may permit production of nonwoven fibrous webs containing fine fibers with a narrow distribution in fiber diameter. Other exemplary embodiments of the present disclosure may have structural features that enable their use in a variety of applications; may have exceptional absorbent and/or adsorbent properties; may have exceptional thermal resistance, may exhibit high porosity, high fluid permeability, and/or low pressure drop when used as a fluid filtration medium and may be manufactured in a cost-effective and efficient manner.

In other exemplary embodiments, the disclosure provides a process and apparatus for the production of relatively strong composite fibrous webs of discontinuous fibers made of polymeric materials, which fibrous webs contain significant amounts of fine fibers suitably dispersed for use as high efficiency filtration media to purify water and other fluids.

In other exemplary embodiments, the disclosure provides an apparatus and method to make high efficiency polymeric composite filtration media incorporating fine fibers which incur relatively low pressure losses associated with the flow of water and other liquids through such media.

In still further embodiments, the disclosure provides a process and apparatus for the production of relatively strong composite fibrous webs of discontinuous fine fibers.

Another advantage of some preferred embodiments of the disclosure is to allow the production of commercial quantities of fine fibers in a manner which avoids the use of organic solvents and which can be employed as at least one of the following media: superabsorbent biodegradable wound care dressings, drug delivery patches, tissue engineering scaffolds, biofiltration membranes.

Another aspect of some preferred embodiments of the disclosure is to prepare nonwoven fibrous webs containing microparticles and/or nanoparticles which are anchored sufficiently in the webs to minimize their subsequent detachment, for example, during the passage of liquids or air through the webs.

In further embodiments, the disclosure provides an apparatus and method to prepare a non-woven fibrous web containing nanoparticles for use as a wound care dressing, in which such nanoparticles are suitably dispersed so as to produce a wound care product with superior small particle holding ability.

In still further embodiments, the disclosure provides a process which allows the creation of a non-woven fibrous web which minimizes the clumping together and clustering of nanoparticles in a wound care dressing.

In still further embodiments, the disclosure provides a process a process which allows the creation of a non-woven fibrous web reinforced with carbon nanotubes in a manner which overcomes the low mechanical strength of the non-woven fibrous web.

In yet further embodiments, the disclosure provides a process to make polymeric/nanoparticle composite media incorporating nanoparticles with efficiencies high enough to eliminate the need for separate coating of the fine fiber web, thereby avoiding the costs of coating the fibers and the potential loss of filtration or drug delivery efficiency which results from the loss of coated media of while it is in storage or in use.

Another object of some preferred embodiments of this disclosure is to make polymeric composite non-woven fibrous webs incorporating nanoparticles which can be released in a controlled manner over time to extend and maintain the effect of particle delivery or filtration, and to reduce the burst effect from high nanoparticle loading.

In still another aspect, the disclosure relates to methods of production of biodegradable filtration media which avoid the high cost and potential for pollution of solvents.

In still another embodiment, the disclosure relates to polymeric/nanoparticle composite filtration media incorporating different polymers and nanoparticles in an economical manner.

The disclosure further relates to a two-phase flow process for the production of a three-dimensional coform monolithic, nonwoven, polymeric material comprising a first distribution of nanofibers and at least one secondary material. The secondary material can be a second distribution of nanofibers or fine fibers, melt-blown fibers, spunbond fibers, liquids, powders or particulates.

In a preferred embodiment, the process for producing a coform fibrous material comprise supplying a first fiber forming stream comprising a first phase comprising a polymer melt and a second phase comprising a pressurized gas to a two-phase flow nozzle; supplying a separate second stream containing at least one secondary material to the two-phase flow nozzle; combining the first fiber forming stream and the second stream to form a composite fiber forming stream; and fibrillating the composite fiber forming stream into a coform fibrous web.

In a further embodiment, the polymeric fine fibers are comprised of nanofibers.

In a further embodiment, the secondary material comprises nanoparticles.

In a further embodiment, the secondary material the secondary material is anchored in the coform fibrous web without adhesives or binders.

In a further embodiment, the two phase nozzle has an annular configuration.

In a further embodiment, the two-phase nozzle has a substantially linear configuration.

In a further embodiment of the above process, the fibers of the first stream are formed from a fiber forming material comprising a polymer melt or solution selected from polypropylene (PP), polyethylene (PE), polyethylene terephthalate (PET), polybutylene terephthalate (PBT), polystyrene (PS), polyacrylonitrile (PAN), polycarbonate (PC), PVDF, Polymer methyl methacrylate, polyurethane, polyesters, polyamides, and polyvinyl chloride, polyvinylidene based polymers and polycaprolactone (PCL).

In a preferred embodiment, the coform fibrous material comprises a uniform distribution of polymeric fine fibers wherein the polymeric fine fibers are produced by supplying a first phase comprising a polymer melt and a second phase comprising a pressurized gas stream to a two-phase flow nozzle and at least one secondary material dispersed within the coform fibrous material.

In a preferred embodiment, a film fibrillation process produces a first uniform distribution of nanofibers with an median diameter of 500 nm from a first polymer and a second uniform distribution of fine fibers with a median diameter of 5 microns and where the first and second distribution are combined into a monolithic homogeneous fibrous layer with a porosity greater than 85% an efficiency of greater than about 99.97% when capturing aerosol particles of about 0.3 microns in size measured at a face velocity of 5.33 cm/s and a pressure drop of less than about 40 millimeters water column at a flow rate of about 32 liters/minute through a sample 100 cm 2 in size.

In another preferred embodiment, a film fibrillation process produces a first uniform distribution of submicron fibers with an median diameter of 500 nm and a spunbond process produces a second distribution of fine fibers with a median diameter of 20 microns and where the first and second distributions are combined into a monolithic homogeneous fibrous layer with a porosity greater than 85%.

In a further embodiment the coform fibrous material where the particles comprise an activated carbon powder.

In a further embodiment, the coform fibrous material where the first uniform distribution comprises less than 20% by weight of the fibrous material.

In a further embodiment, the coform fibrous material where the particles comprise superabsorbent particles.

In a further embodiment, the coform fibrous material where the first uniform distribution comprises less than 40% by weight of the fibrous material.

In another preferred embodiment, a first melted polymer is extruded under pressure into a spinning nozzle to form a first stream of nanofibers; meltblown or spunbond fibers are aspirated into the spinning nozzle; the first stream of nanofibers and the second stream of meltblown or spunbond fibers are released into a region of lower pressure and temperature and deposited onto a receiving surface.

In still another preferred embodiment, a first melted polymer is extruded under pressure into a spinning nozzle to form a first stream of nanofibers; particulates are aspirated into the spinning nozzle; the first stream of nanofibers and the second stream of particulates are released into a region of lower pressure and temperature and deposited onto a receiving surface.

For applications such as filtration, it is desirable to have a certain amount of larger fibers throughout the fibrous web as it provides a scaffold against which higher pressure can be applied without collapsing the fibrous scaffold. The resistance to pressure is dependent on the percentage of larger fibers contained in the fibrous web. If the percentage is too low the fibrous web will collapse and the loftiness of the structure can no longer be maintained. This is turn will increase the pressure drop as porosity drops dramatically together with the closing of pores. On the other hand, if the percentage of large fibers becomes too large then the particle capture efficiency will remain low. Particle capture efficiency is a function of pore size and larger pores will let more particles through.

Polymer nanofibers are known, however their use in filtration has been very limited due to their fragility to mechanical stresses, limited porosity and the susceptibility of nanofiber webs to fuse under applied pressure. The process for the fabrication of monolithic fibrous scaffolds described in this invention address these limitations and will therefore be suitable for the production of materials in a very wide variety of high efficiency air and liquid filtration, membrane and other diverse applications.

In a preferred embodiment, a two-phase flow process produces a filtration material with high porosity where low pressure drop is maintained when multiple layers of fibers are stacked together.

In a preferred embodiment of the invention, the process produces a coform fibrous filtration material that can maintain low pressure drop and high particle capture efficiency over an extended period of time.

An ideal particulate filter is the one that would give the highest particle collection efficiency (lowest particle penetration) with the least pressure drop. The current disclosure teaches how the drawbacks of current coform processes can be overcome by a monolithic filter material comprising a polydisperse distribution of nanofibers and fine fibers leading to better filtration efficiency and decreased pressure drop.

Various aspects and advantages of exemplary embodiments of the present disclosure have been summarized. The above summary is not intended to fully describe or limit each illustrated embodiment or every implementation of the present disclosure. The Drawings and the Detailed Description that follow more particularly exemplify certain preferred embodiments using the principles disclosed herein.

DETAILED DESCRIPTION

Definitions

Figure 1:
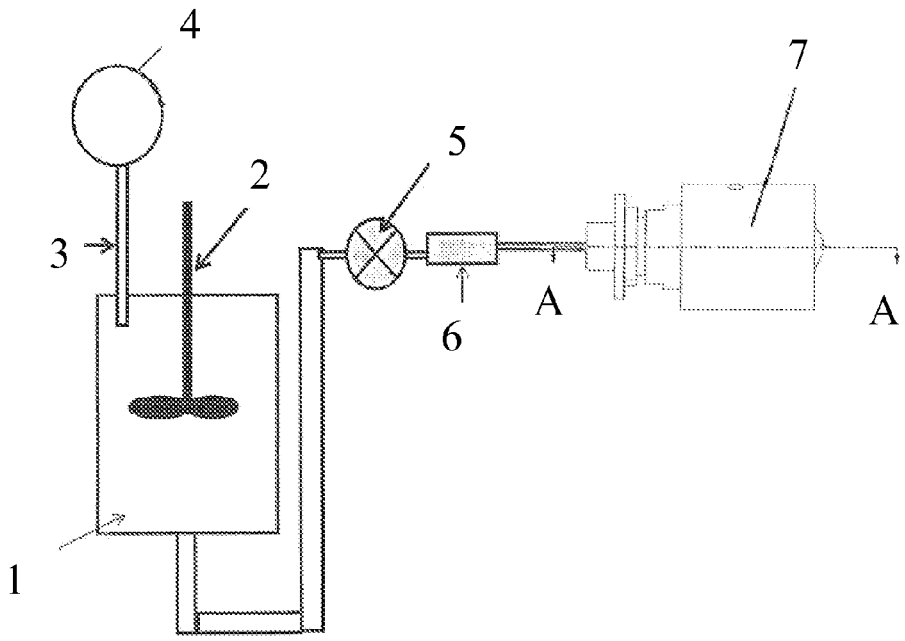
FIG. 1 is a generalized view of a process to produce nanofibers according the present disclosure.

As used herein, the term "coform nonwoven web" or "coform material" means composite materials comprising a mixture or stabilized matrix of thermoplastic filaments and at least one additional material, usually called the "second material" or the "secondary material".

As used herein the term "two-phase flow process" refers to a fiber spinning process whereby a first phase comprised of a melted polymer and a second phase comprised of a gas or liquid are mixed and extruded under pressure through a nozzle into an area of lower pressure and temperature. The extrusion of the two-phase flow into an area of low pressure and temperature produces multi-fibrous filaments upon exit from the nozzle.

As used herein the term "spunbond fibers" refers to small diameter fibers of molecularly oriented polymeric material. Spunbond fibers may be formed by extruding molten thermoplastic material as filaments from a plurality of fine, usually circular capillaries of a spinneret with the diameter of the extruded filaments then being rapidly reduced. Spunbond fibers are generally not tacky when they are deposited onto a collecting surface and are generally continuous. Spunbond fibers are often about 10 microns or greater in diameter.

As used herein, the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Meltblown fibers are microfibers, which may be continuous or discontinuous, and are generally smaller than 10 microns in average diameter.

As used herein, the phrase "nanofibers" refers to fibers having an average fiber diameter less than about 1 micron.

As used herein, the phrase "fine fibers" is intended to represent filaments having an average fiber diameter less than about 5 microns.

Fiber Forming Two Phase Flow Nozzle

Melt film fibrillation nozzles described in the prior art differ from the fiber forming nozzles in the current disclosure in how the fibers are made and the starting melt geometry from which a fibrous web is produced. Melt film fibrillation processes of the prior art start with a single phase polymer flow that is impinged by a separate working air stream. The polymer melt film tube is thinned to a polymer film from the shearing action of the air stream. The polymer stream and the working air streams are combined externally to the nozzle at the nozzle exit. The shearing action of the inner gas stream and the effect of the outer gas stream produces a multiplicity of fibers.

In contrast, the process of the current disclosure utilizes a mixing chamber to produce a two-phase polymer-gas mixture within the fiber-forming nozzle. The two-phase flow under pressure is then uniformly distributed to and forced through a film forming channel of high length to width ratio. This two phase flow of polymer and working gas in the same narrow long channel within the spin nozzle before the nozzle exit is a novel feature of the disclosure. Without being bound by theory, it is believed that in the long narrow channel, the higher viscosity polymer phase forms a film along both surfaces of the channel while the air separates and is forced through the center of the channel. The long narrow channel geometry and control of the magnitude and ratio of polymer melt and gas flows determine the thickness and other attributes of the polymer film. Upon exiting the channel, these in combination with the aerodynamic forces of the gas jet cause the polymer film to disintegrate into a multitude of finer filaments. The thinner the polymer film upon exit from the film forming channel, the finer the ultimate fibers produced. Thus, by varying the polymer flow rate and the gas velocity, it is possible to control film thickness and hence the fine fiber diameter.

In one embodiment the mixing chamber is a two-phase chamber and the long narrow film forming channel has a converging conical geometry. Heated pressurized air, together with a polymer melt under pressure are both injected into the two-phase chamber where the mixture combines to form a two-phase flow. The rotational two phase flow in the two-phase chamber is converted into an axial flow along the length of a narrow converging conical channel. As the converging flow geometry decreases flow area, the accelerating gas velocity in turn increases shearing forces on the polymer film as the polymer progresses along the channel tending to thin the polymer film. However, that same converging flow geometry reduces the wall area supporting the polymer film which tends to increase the film thickness. Balancing these opposed effects offers unique control over the resulting fiber size and the fiber size distribution.

Apparatus and System for Forming Nanofibrous Materials

The present disclosure relates to apparatus and methods for forming non-woven nanofibrous materials. The non-woven nanofibrous materials are formed from one or more thermoplastic polymers. Generally suitable polymers include any polymers suitable for melt spinning. The melting temperature is generally from about 25 C to 400 C. Nonlimiting examples of thermoplastic polymers include polypropylene and copolymers, polyethylene and copolymers, polyesters, polyamides, polystyrenes, biodegradable polymers including thermoplastic starch, PHA, PLA, PCL, PLGA, polyurethanes, and combinations thereof. Preferred polymers are PCL, PLA, PLGA and other biodegradable linear aliphatic polyesters. Optionally, the polymer may contain additional materials to provide additional properties for the fiber. These may modify the physical properties of the resulting fiber such as elasticity, strength, thermal or chemical stability, appearance, liquid absorbency, surface properties, among others. A suitable hydrophilic melt additive may be added. Optional materials may be present up to 50% of the total polymer composition. It may be desired to use a mixture of lower and higher molecular weight polymers in a web. The lower molecular weight polymer will fibrillate easier which may result in fibers having different diameters. If the polymers will not blend, separate nozzles may be utilized for the different molecular weight polymers.

The average fiber diameter of a significant number of fibers in the fine fiber layer of the web can be less than one micron and preferably from about 0.1 microns to 1 micron, more preferably from about 0.5 microns to about 0.9 microns. The basis weight of the fine fiber layer can be less than about 25 gsm, commonly from about 0.1 to about 15 gsm, preferably less than 10 gsm or 5 gsm. The fine fiber layer may have a basis weight in the range of from about 0.5 to about 3 gsm or from about 0.5 to about 1.5 gsm, depending upon use of the nonwoven web.

Process for Producing Uniform Fibers

Current fiber spinning methods such as melt spinning, electrospinning, flash spinning, etc., deposit fibers with a mass distribution centered on the fiber issuing orifice because the probability of fiber deposition is highest at the point of fiber generation. The conical pack of the current disclosure avoids this problem because fiber generation and deposition are distributed uniformly around the circumference of a circle. The result of deposition on a moving take-up device from a single nozzle is a nominally uniform mass profile across the width of the deposition circle.

The laws of physics make it increasingly difficult to distribute mass uniformly from a single fiber generating nozzle as throughput increases. This is because more work, faster is required for distribution as throughput increases. This is not the case with the conical pack. Because of the geometry the uniformity of fiber distribution is nominally independent of throughput. The nozzle of the current disclosure provides therefore a unique capability to make uniform webs from a single nozzle at high throughput.

While current film fibrillation methods typically produce non-uniform non-woven fibrous web, a more uniform fibrous web may be desirable for application such as drug delivery or wound care. A uniform fibrous web may have more controllable and predictable drug or active agent release characteristics. Web uniformity can be measured through several methods. (See description of uniformity index (UI) in U.S. Pat. No. 7,118,698 to Armantrout et al). Example 21 deposits fibers with mass distribution centered on the fiber issuing orifice, such as other nonwoven processes; however, the technology of this disclosure lends itself to the design of a fiber forming nozzle with a conical, hollow laydown wherein the fiber generation and deposition are distributed uniformly around the circumference of a circle (see FIG. 32). Examples of uniformity metrics include low coefficient of variation of pore diameter, basis weight, air permeability, and/or thermal resistance. Uniformity may also be evaluated by the hydrohead or other liquid barrier measurement of the web. The relative distribution of microfibers in the non-woven fibrous web depends on the application and the polymer used. Certain thermoplastic polymers such as PCL offer greater compression resistance and elasticity retaining its original shape after compression. The table below compares the uniformity levels of non-woven materials produced with the method of the current disclosure to other nonwoven materials. The uniformity of the produced materials with the methods of the current disclosure approaches that of films. In a preferred embodiment the UI of the material produced is between 2 and 6.

| NON-WOVEN | UNIFORMITY INDEX |
|---|---|
| TYVEK | 18 |
| Melt-blown | 10 |
| Kraft paper | 7 |
| Films | 2 |
| Disclosure | 2-6 |

Process for Spinning Nanofibers into Non-Woven Materials

Figure 4:
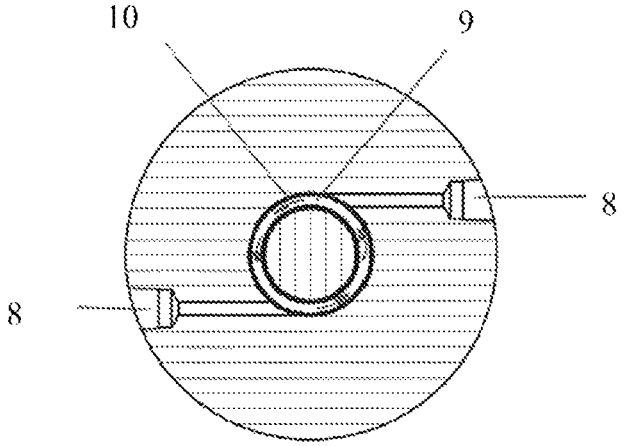
FIG. 4 is cross-sectional view of a mixing chamber according to the disclosure.
Figure 5:
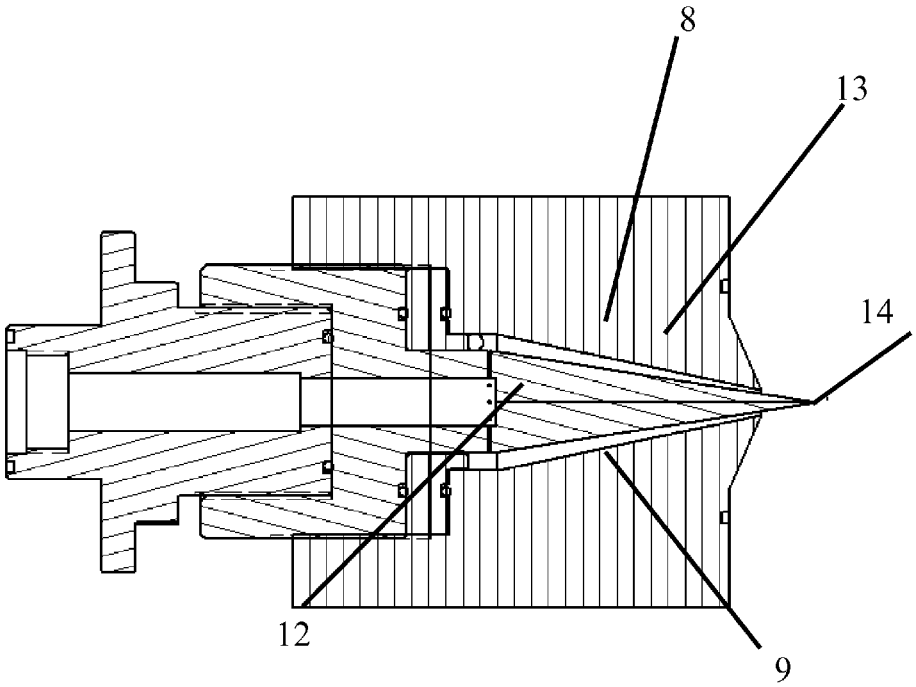
FIG. 5 is cross-sectional view of a two-phase flow nozzle according to the disclosure.
Figure 6:
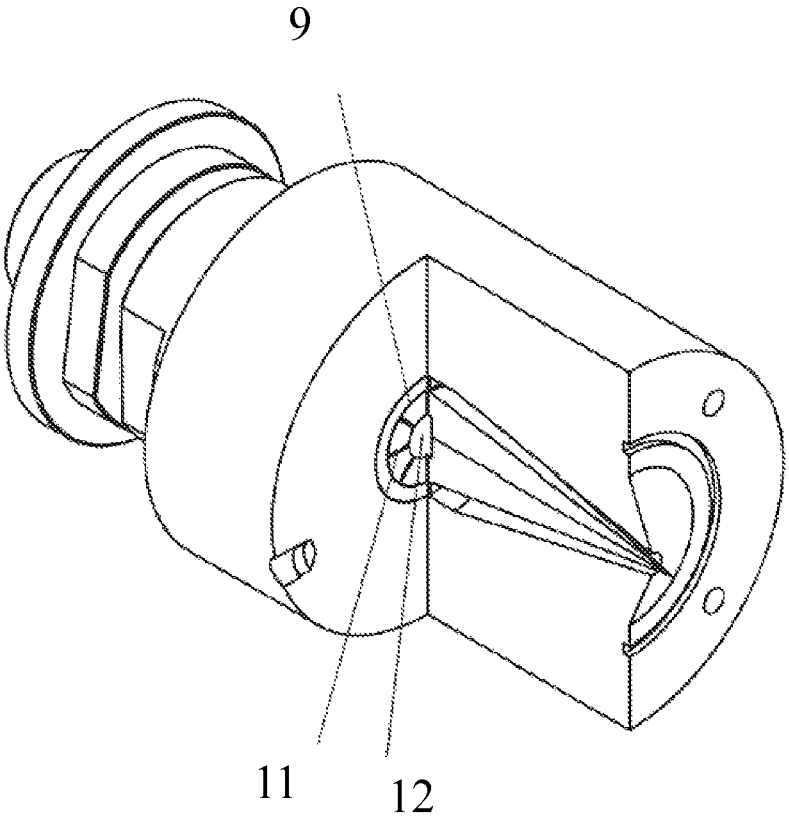
FIG. 6 is a cut-out perspective view of a converging channel according to the disclosure.
Figure 7:
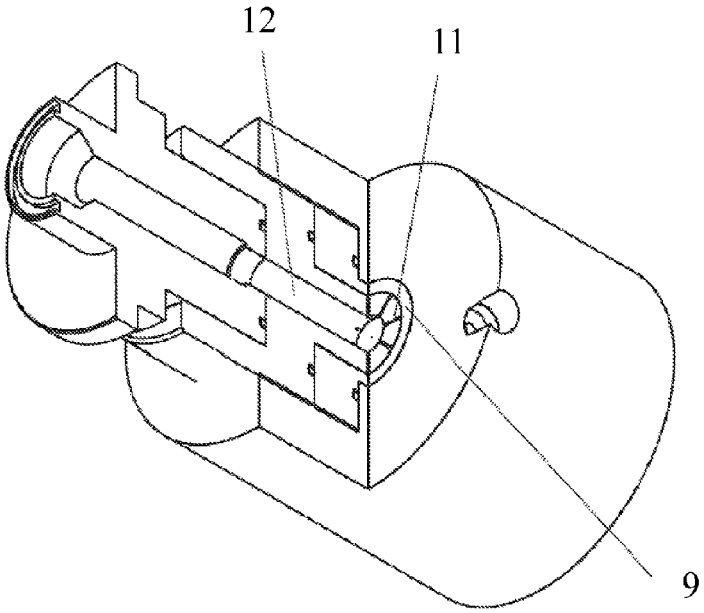
FIG. 7 is a cut-out perspective view of a polymer feeding tube according to the disclosure.
Figure 8:
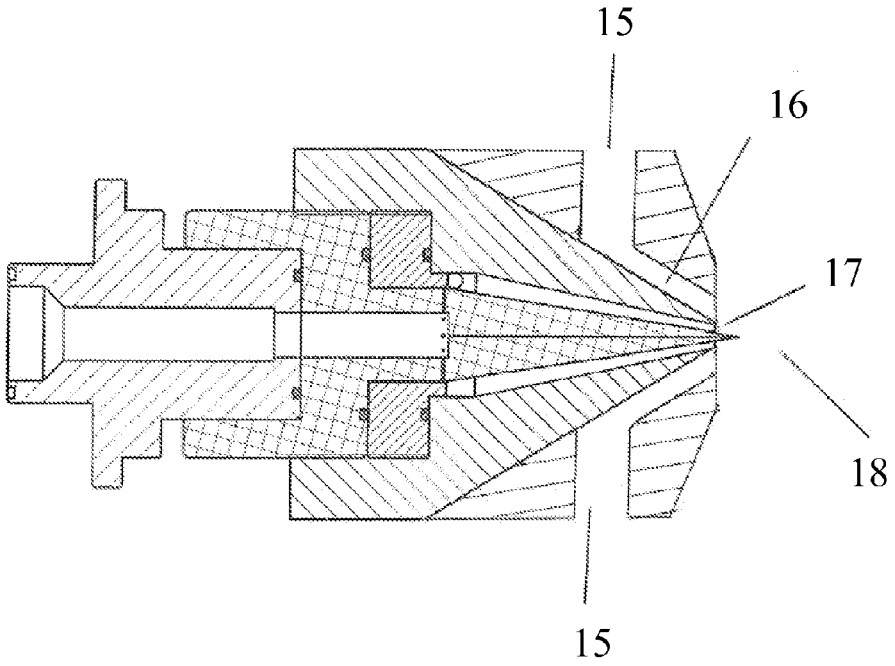
FIG. 8 is cross-section view of a two-phase flow nozzle according to the disclosure with a particle loading option.

A process for spinning polymer submicron fibers into non-woven webs without the use of solvents according to the present disclosure is shown in FIG. 1 and consists of the following process steps: The two-phase method for spinning polymeric fibers without the use of solvents is shown in FIG. 1 and consisted of the following process steps: polymer was heated and stirred in a reactor vessel 1 to the desired spinning temperature (the polymer temperature). The stirrer 2 was stopped and ambient air was fed through a pressurization line 3 to establish a head pressure 4 on the melted polymer (the polymer pressure). The valve 5 was opened and pressurized polymer was forced out of the reactor vessel 1 through the valve 5 and then through a filter 6 and into the nozzle 7. Heated, pressurized air was injected through ports 8 (see FIG. 2, FIG. 3, FIG. 4, and FIG. 5) into the mixing chamber 9 of the two phase flow nozzle creating a rotational flow 10 (see FIG. 4). Heated polymer was injected into the two-phase chamber 9 through eight orifices 11 (see FIG. 6, FIG. 7) spaced at 45 degree locations around a cylindrical polymer feed tube 12. The two-phasing air flow mixed with the polymer creating a two-phase flow which was then forced through a converging channel 13. The decreasing area of the converging channel 13 forced an increase in air speed along the axis of the nozzle and transitioned the rotational flow in the two-phase chamber into a mainly axial flow as it exited the nozzle through the annular orifice 14. It is believed that: the polymer is sheared by the accelerating gas flow within the converging channel creating polymeric film layers on both sides of the converging channel 13. These polymeric film layers were sheared into fibers by the accelerated gas flow such that resulting fiber fineness corresponded to the thickness of the polymeric film. One aspect of the process is that the total volumetric polymer flow can be easily regulated by the number of polymer injection orifices 11, thus creating a way to vary film thickness at the exit annular orifice 14 and hence fiber size. Heated air carrying powder(s) was injected 15 (see FIG. 8) into the two-phase nozzle and forced into an annulus 16 such that this flow impinged upon and into 17 the two-phase flow of polymer and heated air while the polymer was still above its melt temperature. The combined flows then mixed and the powder(s) became attached to the fibers. In a preferred embodiment, the fibers are collected on a screen at a distance of approximately 12-28 in from the exit of the two-phase nozzle.

In an alternate embodiment of the process, the solidified issued material is collected at a set distance from the exit of the two-phase nozzle, also referred to herein as the "collection surface". The collector can be a stationary flat porous structure made from perforated metal sheet or rigid polymer. The collector can be coated with a friction-reducing coating such as a fluoropolymer resin, or it can be caused to vibrate in order to reduce the friction or drag between the collected material and the collection surface. The collection surface is preferably porous so that vacuum can be applied to the material as it is being collected to assist the pinning of the material to the collector. In one embodiment, the collection surface comprises a honeycomb material, which allows vacuum to be pulled on the collected material through the honeycomb material while providing sufficient rigidity not to deform as a result. The honeycomb can further have a layer of mesh covering it to collect the issued material.

The collection surface can also be a component of the desired product itself. For instance, a preformed sheet can be the collection surface and a thin layer can be issued onto the collection surface to form a thin membrane on the surface of the preformed sheet. This can be useful for enhancing the surface properties of the sheet, such as printability, adhesion, porosity level, and so on. The preformed sheet can be a nonwoven or woven sheet, or a film. In this embodiment, the preformed sheet can even be a nonwoven sheet formed in the process of the disclosure itself, and subsequently fed through the process of the disclosure a second time, supported by the collection belt, as the collection surface. In another embodiment of the present disclosure, a preformed sheet can even be used in the process of the disclosure as the collection belt itself.

The collection surface can alternatively comprise a flexible collection belt moving over a stationary cylindrical porous structure. The collection belt is preferably a smooth, porous material so that vacuum can be applied to the collected material through the cylindrical porous structure without causing holes to be formed in the collected material.

The collection surface can alternatively further comprise a substrate such as a woven or a nonwoven fabric moving on the moving collection belt, such that the issued material is collected on the substrate rather than directly on the belt. This is especially useful when the material being collected is in the form of very fine particles.

In one embodiment of the disclosure in which the material being issued comprises a polymeric fibrous material, the material collected on the collection surface is heated sufficiently to bond the material. This can be accomplished by maintaining the temperature of the atmosphere surrounding the collected material at a temperature sufficient to bond the collected material. The temperature of the material can be sufficient to cause a portion of the polymeric fibrous material to soften or become tacky so that it bonds to itself and the surrounding material as it is collected. A small portion of the polymer can be caused to soften or become tacky either by heating the issued material before it is collected sufficiently to melt a portion thereof, or by collecting the material and immediately thereafter, melting a portion of the collected material by way of the heated gas passing therethrough. In this way, the process of the disclosure can be used to make a self-bonded nonwoven product, wherein the temperature of the gas passing through the collected material is sufficient to melt or soften a small portion of the web but not so high as to melt a major portion of the web.

Various methods can be employed to secure or pin the material to the collection surface. According to one method, vacuum is applied to the collection surface from the side opposite the collection surface at a sufficient level to cause the material to be pinned to the collection surface.

As an alternative to pinning the material by vacuum, the material can also be pinned to the collection surface by electrostatic force of attraction between the material and the collection surface, the collecting cylindrical structure, or the collection belt, as the case can be for a particular embodiment of the disclosure. This can be accomplished by creating either positive or negative ions in the gap between the nozzle and the collection surface while grounding the collection surface, so that the newly issued material picks up charged ions and thus the material becomes attracted to the collection surface. Whether to create positive or negative ions in the gap between the nozzle and the collector is determined by what is found to more efficiently pin the material being issued. It has surprisingly been found that the uniformity index of the produced material improves with the application an electrical charge.

In order to create positive or negative ions in the gap between the nozzle and the collection surface, and thus to positively or negatively charge the solidified issued material passing through the gap, one embodiment of the process of the present disclosure employs a charge-inducing element installed on the nozzle. The charge-inducing element can comprise pin(s), brushes, wire(s) or other element, wherein the element is made from a conductive material such as metal or a synthetic polymer impregnated with carbon. A voltage is applied to the charge-inducing element such that an electric current is generated in the charge-inducing element, creating a strong electric field in the vicinity of the charge-inducing element which ionizes the gas in the vicinity of the element thereby creating a corona. The amount of electrical current necessary to be generated in the charge-inducing element will vary depending on the specific material being processed, but the minimum is the level found to be necessary to sufficiently pin the material, and the maximum is the level just below the level at which arcing is observed between the charge-inducing element and the grounded collection belt.

Process for Making Coform Fibrous Materials

Figure 33:
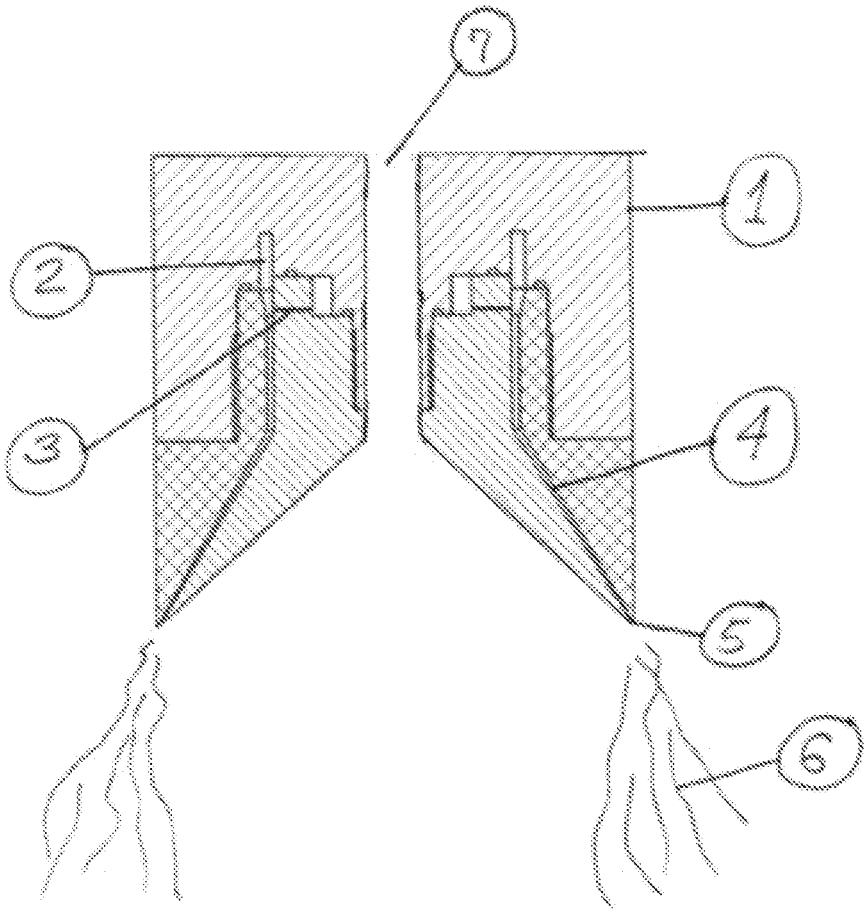
FIG. 33 illustrates an embodiment of the coforming apparatus and process for making a coform fibrous material where both nanofibers and microfibers are spun simultaneously.

FIG. 33 illustrates a preferred embodiment of an apparatus and process for making a coform fibrous web where both nanofibers and microfibers are spun simultaneously. The nozzle 1 shown in cross-section in FIG. 33 is an axisymmetric design. In this version of a swirling flow nozzle, the design is such that it is a diverging design in terms of the exiting jet flow pattern. Heated gas is injected into a swirl chamber 2 by two orifices, creating a swirling rotating flow about the axis of the nozzle. A heated polymer melt is injected into the swirl chamber 2 through orifices 3. The swirling, rotating gas flow mixes with the polymer and forms a two-phase polymer-gas flow. The two-phase polymer-gas flow subsequently traverses a narrow flow channel 4 flow thereby transferring the two-phase flow to the exit gap 5. At the exit gap the two-phase flow is broken into discrete elements or streams which are attenuated to become polymeric fibers 6. The axisymmetric nozzle 1 contains a hollow cylindrical hole 7.

Process where the Second Material is a Particulate

Figure 2:
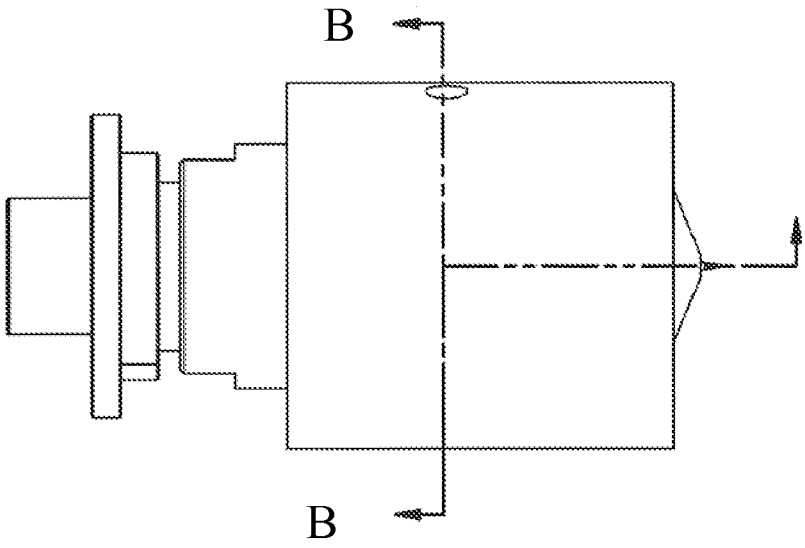
FIG. 2 is a sectional view of a two-phase flow nozzle according to the disclosure.
Figure 3:
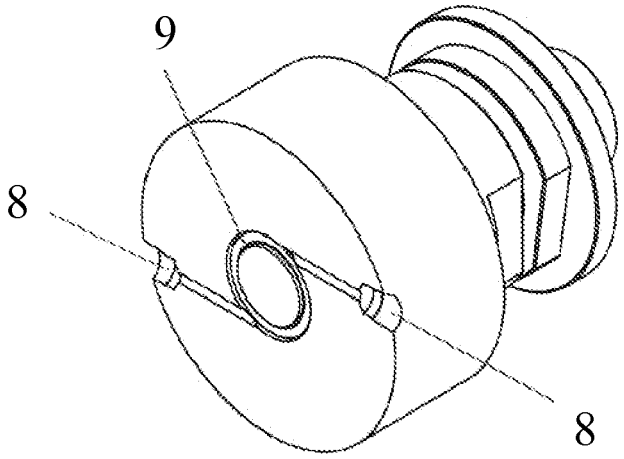
FIG. 3 is a perspective view of a two-phase flow nozzle according to the disclosure.
Figure 34:
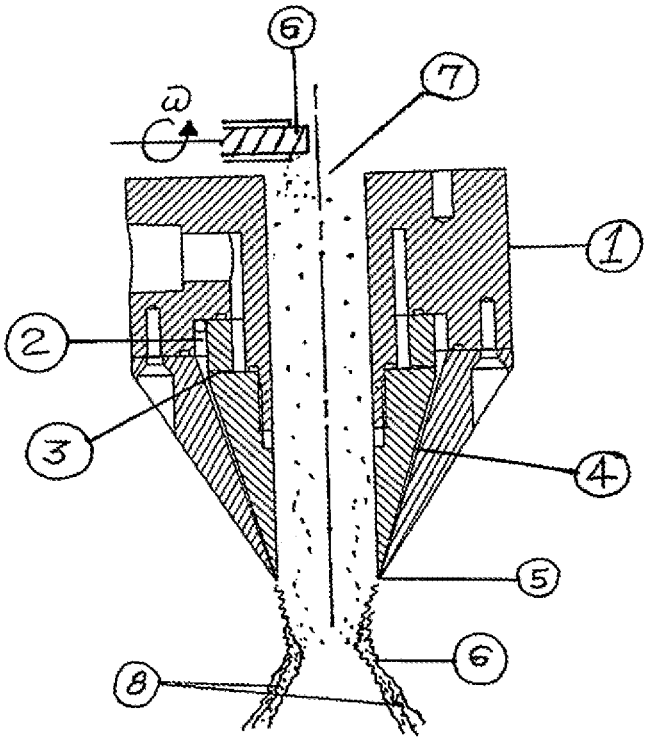
FIG. 34 illustrates an embodiment of the coforming process where the second material is a particulate.
Figure 35:
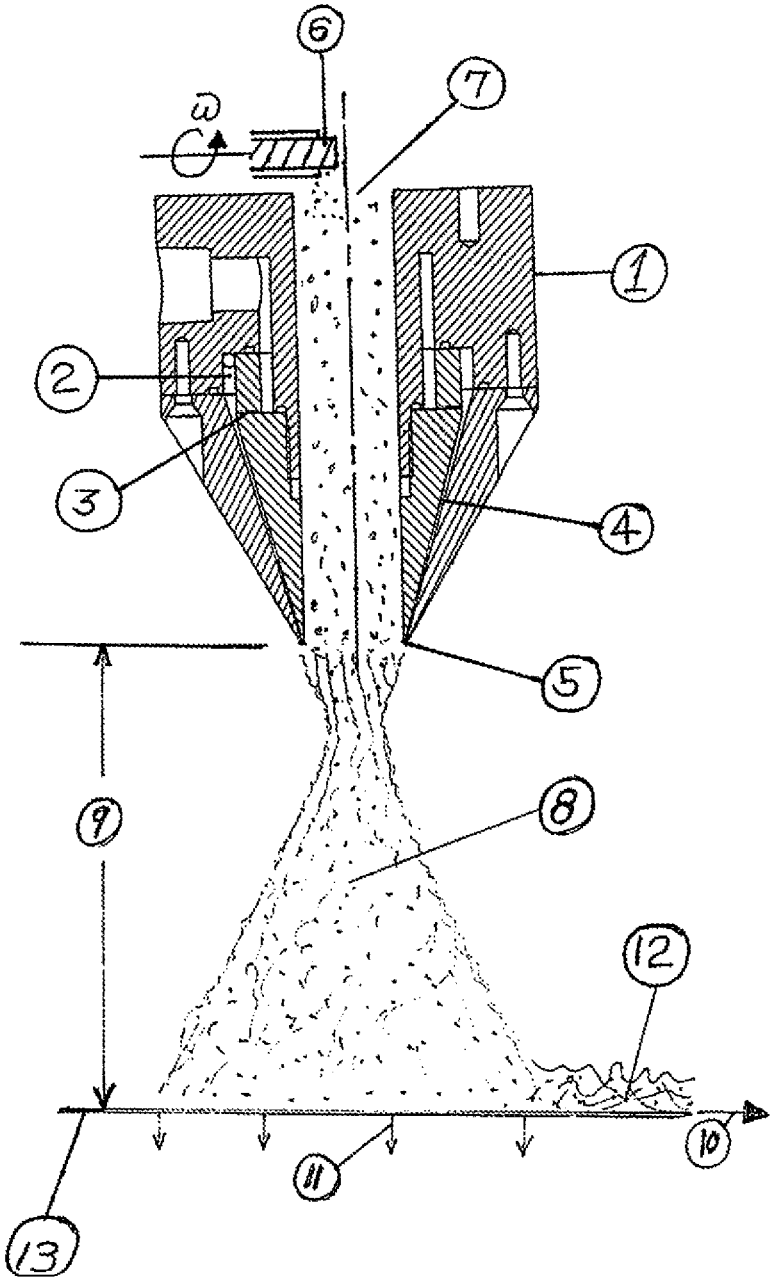
FIG. 35 illustrates an embodiment of the coforming process where the second material is a particulate.

FIG. 34 illustrates a preferred embodiment of the coforming process where the second material is a particulate. The nozzle 1 shown in cross-section in FIG. 1 is an axisymmetric design. Heated gas is injected into a swirl chamber 2 by two orifices, creating a swirling rotating flow about the axis of the nozzle. A heated polymer melt, comprising a mixture of substances is injected into the swirl chamber 2 through orifices 3. The swirling, rotating gas flow mixes with the polymer (mixture of substances) and forms a two-phase flow. The two-phase flow subsequently traverses a narrow flow channel 4 thereby transferring the two-phase flow to the exit gap 5. At the exit gap the two-phase flow is broken into discrete elements or streams which are attenuated to become polymeric fibers 6. The axisymmetric nozzle 1 contains a hollow cylinder 7. The hot gas jet issuing from axisymmetric gap 5 creates a negative pressure in this region which aspirates gas through the hollow cylinder 7. The gas flow naturally aspirated through hollow cylinder 7 enables powder particles 8 from feed apparatus, here a screw 6 to be aspirated directly into the fiber making process. FIG. 35 shows how the powder particles 8 are substantially enveloped and contained within the fiber making stream. They are both attached onto the fibers and entrapped within the fibrous structure of the envelope of the forming jet 10, such that very few powder particles escape. The powder particles are efficiently contained in the web 11. The nozzle gap 5 is located at a distance 12 from a collecting surface 13 as shown in FIG. 2. The fibers with attached powder are formed into a sheet or web material by vacuum 14 and a moving collection surface 13.

The Polymers

The example above uses polypropylene (PP) fibers but other polymers can be used such as polyethylene (PET), polystyrene (PS), polyacrylonitrile (PAN), polycarbonate (PC), PVDF, Polymer methyl methacrylate, polyurethane, polyesters, polyamides, and polyvinyl chloride, polyvinylidene based polymers, polycaprolactone, and so on. Combinations of polymers with dissimilar properties can provide increased performance for application such as filtration.

The nanofibrous web may be made from organic or inorganic materials including, but not limited to, polymers, engineered resins, cellulose, rayon, glass, metal, activated alumina, carbon nanotubes or graphene, silica, zeolites, or combinations thereof. Combinations of organic and inorganic materials are contemplated and within the scope of the invention as for example, polymeric fibers and carbon nanotubes may be used together.

Preferably, a significant portion of the fibers should have a diameter less than or equal to about 1000 nanometers, more preferably less than or equal to about 500 nanometers. When the filter material is produced from polymeric nanofibers, such fibers should also have a high loft (fill power). Fibrillated fibers are most preferred due to their exceptionally fine dimensions and potentially low cost.

Preferably, fibrillated polymeric nanofibers, processed in accordance with the present disclosure, can produce fibrous webs of high porosity. Polymer materials that can be used in the polymeric compositions of the invention include both addition polymer and condensation polymer materials such as polyolefin, polyacetal, polyamide, polyester, cellulose ether and ester, polyalkylene sulfide, polyarylene oxide, polysulfone, modified polysulfone polymers and mixtures thereof. Preferred materials that fall within these generic classes include polyethylene, polypropylene, poly(vinylchloride), polymethylmethacrylate (and other acrylic resins), polystyrene, and copolymers thereof (including ABA type block copolymers), poly(vinylidene fluoride), poly(vinylidene chloride), polyvinylalcohol in various degrees of hydrolysis Such fibrillated nanofibers can be made by direct melt-spinning of a polymer, such as polyethersulfone (PES), polypropylene (PP), polytetrafluoroethylene (PTFE), polyvinylidene fluoride (PVDF), polyvinylidene chloride (PVDC), and polysulfone (PSU). Furthermore, the fibrillated fibers may be produced in large quantities using equipment of modest capital cost. It will be understood that fibers other than those listed above may be fibrillated to produce extremely fine fibrils.

The Particulates

Preferred particulates include seeds, powders, droplets, inorganic absorbent materials and treated polymeric staple fibers, carbon nanotubes or graphene, absorbent fibrous organic materials such as woody and non-wood pulp from, for example, cotton, rayon, recycled paper, pulp fluff; superabsorbent materials such as superabsorbent particles and polymeric fibers produced from other spinning processes such as spunbond, meltblown flashspun or electrospun fibers.

Pack Attenuation of Spunbond Material

Figure 36:
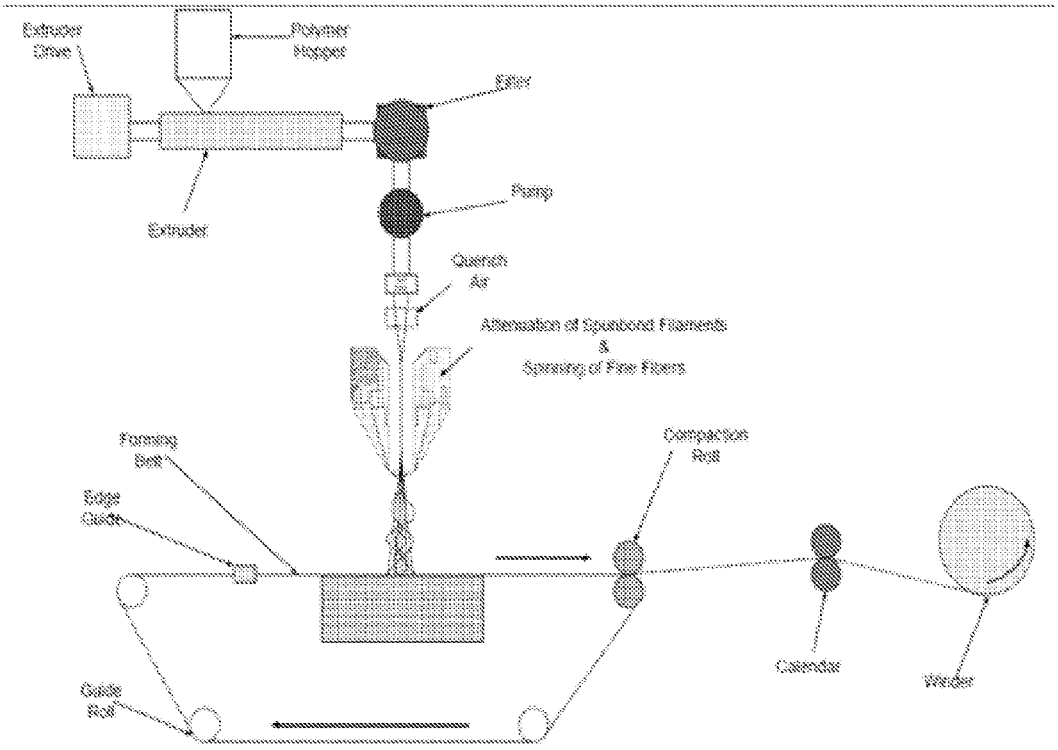
FIG. 36 illustrates an embodiment of the coforming process where the second material comprise spunbond fibers.
Figure 37:
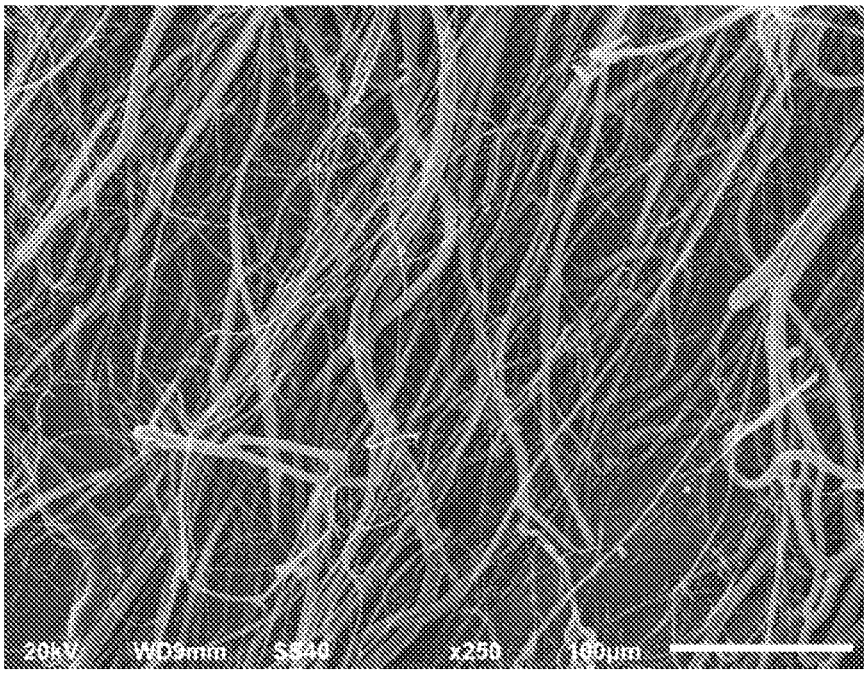
FIGS. 37, 38, 39, 40 and 41 are SEM pictures of coform fibrous webs of nanofibers and fine fibers.
Figure 38:
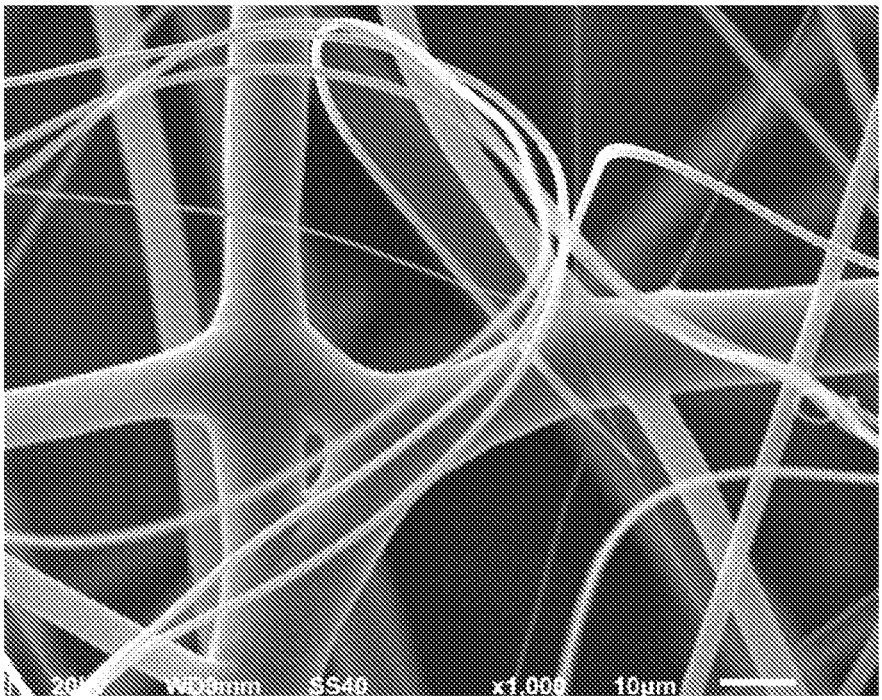
Figure 39:
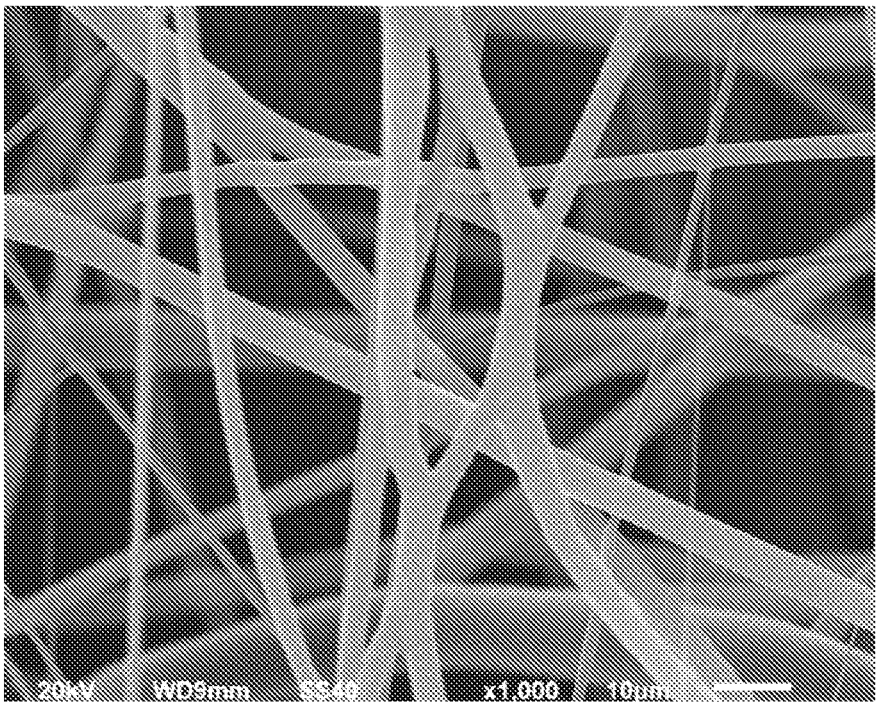
Figure 40:
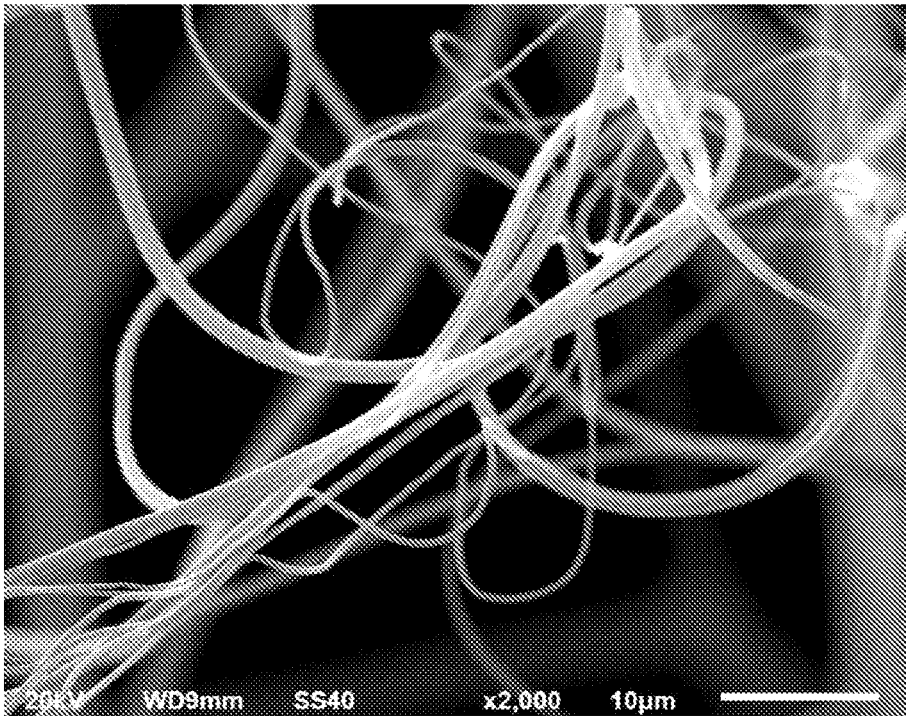
Figure 41:
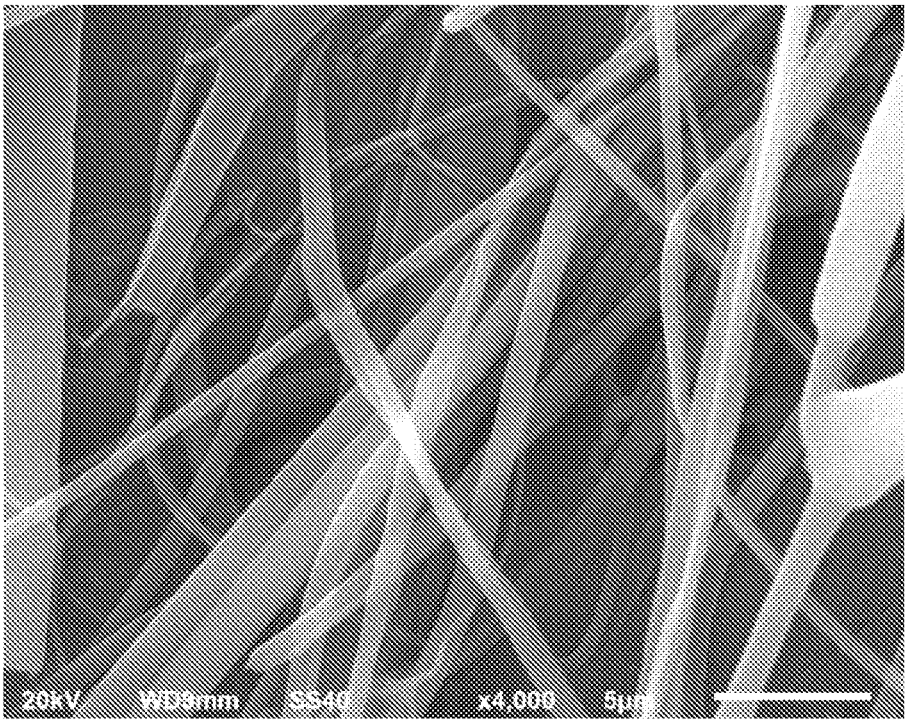

A linear version of a two-phase nozzle is designed such that it aspirates gas flow into an open, central region of the spin pack between two jet flows. Fine fibers and nanofibers are spun with each of the two jets as shown in FIG. 36. The swirling flow spin pack is located such that spunbond filaments can be aspirated into the open, central region by the action of the two jets. The two jets of the swirling flow spin pack exert drag forces on the spunbond filaments and thus "draw" and attenuate the spunbond filaments. As the spunbond filaments exit the swirling flow spin pack they are mixed with the fine fibers and nanofibers being spun with the two jets of swirling flow spin pack. The two jet flows are orientated such that they merge into a single jet flow at some distance downstream of the swirling flow spin pack. This single jet becomes turbulent and therefore mixes and blends the spunbond filaments with the fine fibers and nanofibers. The mixture of spunbond and fine fibers and nanofibers is collected on a moving substrate, belt, or drum and thus forms a single layer comprised of the mixture of fibers.

EXAMPLES

All documents cited are, in relevant part, incorporated herein by reference; the citation of any document is not to be construed as an admission that it is prior art with respect to the present disclosure.

Method Used to Determine Fiber Size Distributions

A scanning electron microscope (SEM) was used to take micrographs of polymer fibers. Various magnifications were used and a scale watermark of 5, 10, 20, or 100 microns was overlaid onto the SEM image accordingly. The SEM picture was imported into PowerPoint®, and an x and y axis was placed onto the picture and related to the micron scale using the line drawing tool. The resulting image was captured and imported into DigitizeIt© (a software program used to digitize points within an image). Lengths (in microns) of the pictured axes were reported to the program relative to the micron scale overlaid onto the SEM image, and two (x,y) data point.

Method Used to Determine the Machine Direction Uniformity Index.

The MD UI of a sheet is calculated according to the following procedure. A beta thickness and basis weight gauge (Quadrapac Sensor by Measurex Infrand Optics) scans the sheet and takes a basis weight measurement every 0.2 inches (0.5 cm) across the sheet in the cross direction (CD). The sheet then advances 0.42 inches (1.1 cm) in the machine direction (MD) and the gauge takes another row of basis weight measurements in the CD. In this way, the entire sheet is scanned, and the basis weight data is electronically stored in a tabular format. The rows and columns of the basis weight measurements in the table correspond to CD and MD "lanes" of basis weight measurements, respectively. Then each data point in column 1 is averaged with its adjacent data point in column 2; each data point in column 3 is averaged with its adjacent data point in column 4; and so on. Effectively, this cuts the number of MD lanes (columns) in half and simulates a spacing of 0.4 inch (1 cm) between MD lanes instead of 0.2 inch (0.5 cm). In order to calculate the uniformity index (UI) in the machine direction ("MD UI"), the UI is calculated for each column of the averaged data in the MD. The UI for each column of data is calculated by first calculating the standard deviation of the basis weight and the mean basis weight for that column. The UI for the column is equal to the standard deviation of the basis weight divided by the square root of the mean basis weight, multiplied by 100. Finally, to calculate the overall machine direction uniformity index (MD UI) of the sheet, all of the UI's of each column are averaged to give one uniformity index. The units for uniformity index are (ounces per square yd)½.

Example 1

Figure 9:
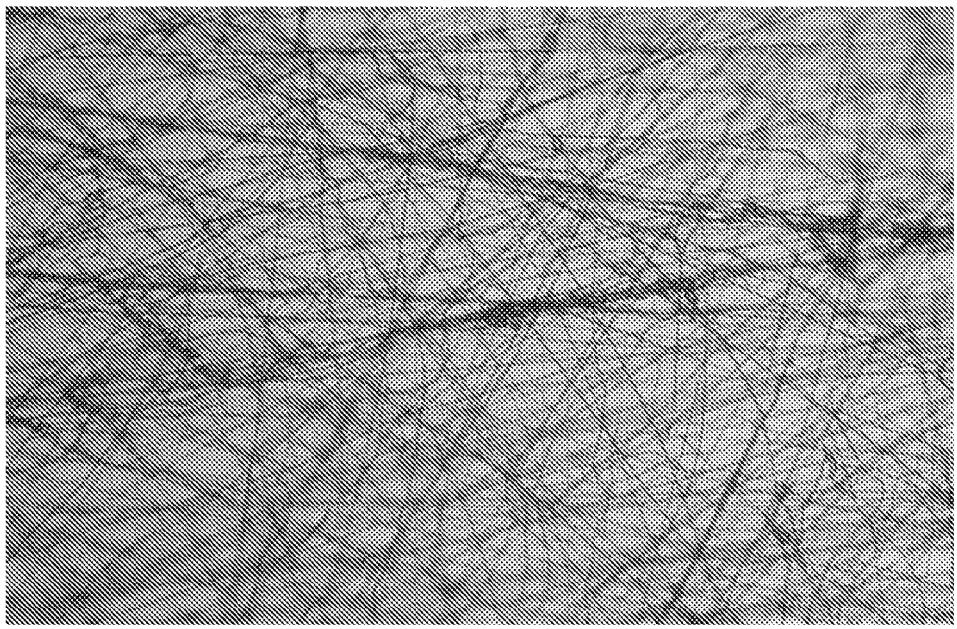
FIG. 9 is a microscope picture of fibers produced according to example 1 of the disclosure.
Figure 10:
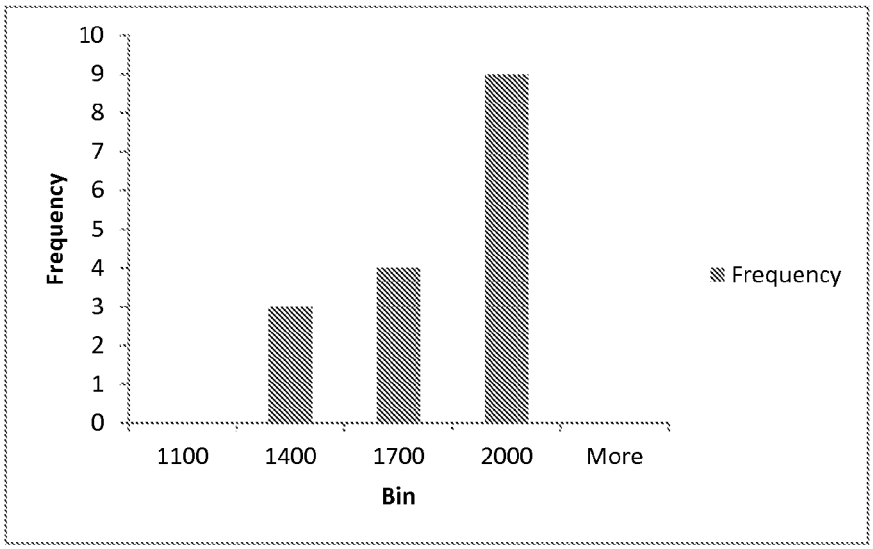
FIG. 10 is the fiber size distribution corresponding to FIG. 9.

A stainless steel reactor vessel (volume=0.5 l) was charged with 70 g of Capa 6100 polycaprolactone polymer (Perstorp) and 30 g of Capa 6500 polycaprolactone polymer (Perstorp). The polymer mixture was heated to 140 C and pressurized to 25 psig. The heated and pressurized polymer was forced through a 140 micron rated filter and then into the two-phase nozzle. Heated air was injected into the two-phase chamber at 171 C and 40 psig. Fibers were produced at a rate of 0.014 g/min. A microscope picture of the fibers produced is shown in FIG. 9. The fiber size distribution is shown in FIG. 10.

Example 2

Figure 11:
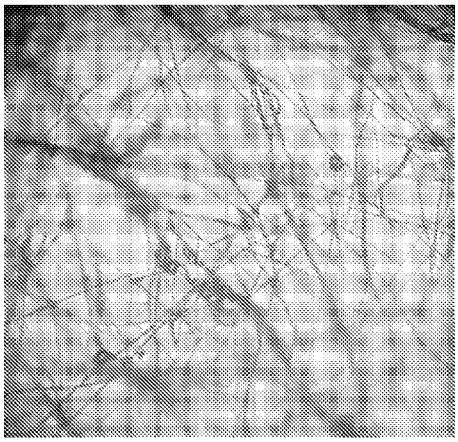
FIG. 11 is a microscope picture of fibers produced according to example 2 of the disclosure.
Figure 12:
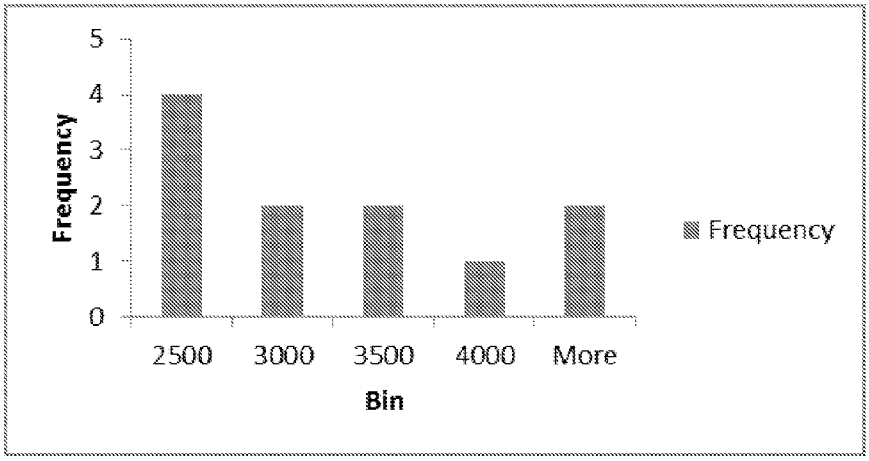
FIG. 12 is the fiber size distribution corresponding to FIG. 11.

A stainless steel reactor vessel (volume=0.5 l) was charged with 70 g of Capa 6100 polycaprolactone polymer (Perstorp) and 30 g of Capa 6500 polycaprolactone polymer (Perstorp). The polymer mixture was heated to 160 C and pressurized to 40 psig. The heated and pressurized polymer was forced through a 140 micron rated filter and then into the two-phase nozzle. Heated air was injected into the two-phase chamber at 181 C and 60 psig. Fibers were produced at a rate of 0.31 g/min. A microscope picture of the fibers produced is shown in FIG. 11. The fiber size distribution is shown in FIG. 12.

Example 3

Figure 13:
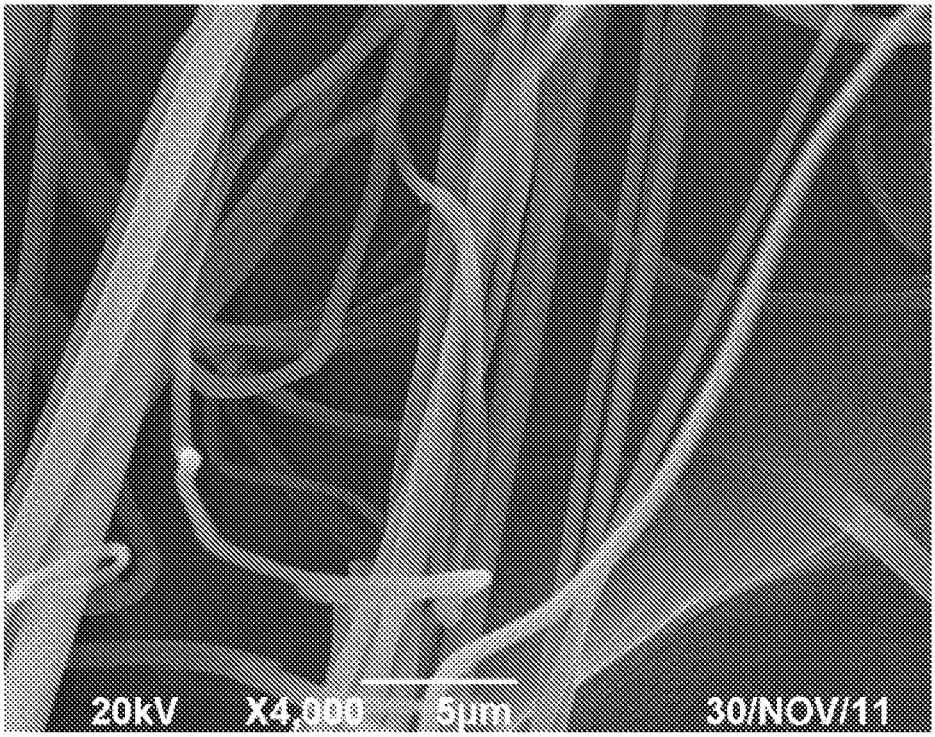
FIG. 13 is a microscope picture of fibers produced according to example 3 of the disclosure.
Figure 14:
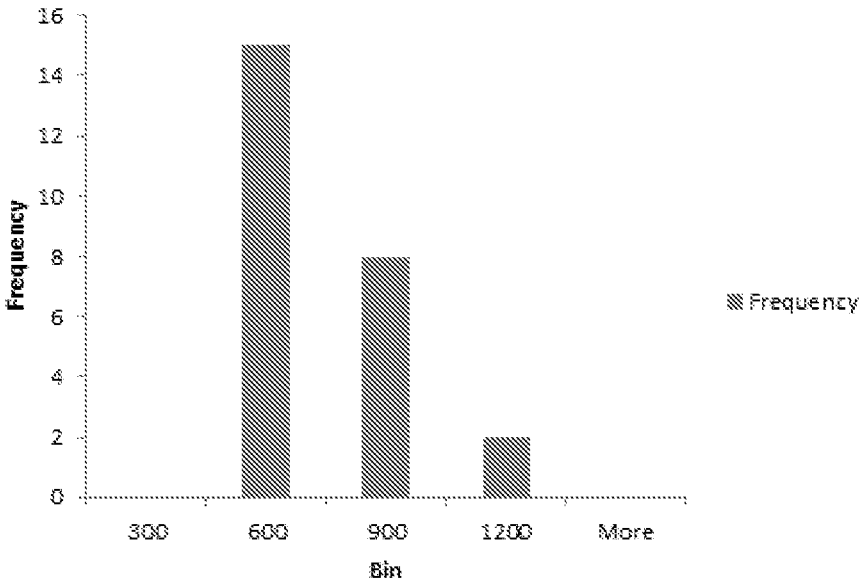
FIG. 14 is the fiber size distribution corresponding to FIG. 13.

A stainless steel reactor vessel (volume=0.5 l) was charged with 70 g of Capa 6100 polycaprolactone polymer (Perstorp) and 30 g of Capa 6500 polycaprolactone polymer (Perstorp). The polymer mixture was heated to 156 C and pressurized to 40 psig. The heated and pressurized polymer was forced through a 140 micron rated filter and then into the two-phase nozzle. Heated air was injected into the two-phase chamber at 225 C and 60 psig. Fibers were produced at a rate of 0.014 g/min. A SEM of the fibers produced is shown in FIG. 13. The fiber size distribution is shown in FIG. 14.

Example 4

Kaolin

Figure 15:
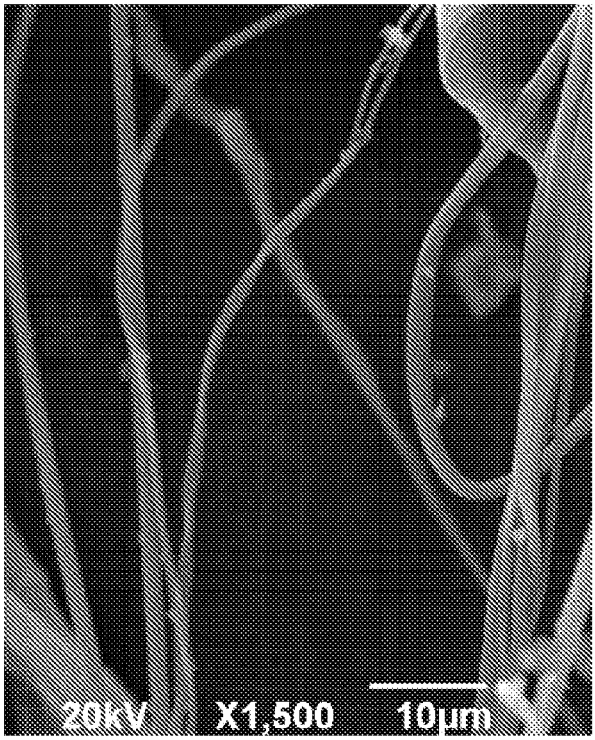
FIG. 15 is an SEM picture of fibers produced in Example 4.

A stainless steel reactor vessel (volume=0.5 l) was charged with 100 g of Capa 6100 polycaprolactone polymer (Perstorp), 30 g of Capa 6500 polycaprolactone polymer (Perstorp), 5 g of Capa 6800 (Perstop), and 0.5 g of Cocamidopropyl Betaine. The mixture was heated to 158 C and pressurized to 38 psig to make example 4-1 and the mixture was heated to 155 C and pressurized to 38 psig to make example 4-2. The heated and pressurized mixture was forced through a 140 micron rated filter and then into the two-phase nozzle. Heated air was injected into the two-phase chamber at 238 C and 40 psig for example 4-1 and heated air was injected into the two-phase chamber at 240 C and 40 psig for example 4-2. A SEM of example 4-1 as spun is shown in FIG. 15. A flow of air and Kaolin powder at 81 C was impinged upon the primary two-phase flow, thereby attaching powder to the polymer mixture melt for example 4-1; and a flow of air and Kaolin powder at 120 C impinged upon the primary two-phase flow, thereby attaching powder to the polymer mixture melt for example 4-2. The production rates where: 0.77 g/min for example 4-1 and 0.81 g/min for example 4-2. The samples as-spun were water washed in stirred beaker to induce some shear on the attached powder. The samples were then "ashed" to determine the amount of powder remaining on the samples.

TABLE 1

| Fibers As-spun | | |
|---|---|---|
| | Water washed | Weight % Kaolin on fibers (average of 4 samples) |
| Example 4-1 | no | 3.4 |
| | Yes | 1.3 |
| Example 4-2 | no | 6.9 |
| | Yes | 0.9 |

Another set of the samples were heated in an oven to 55 C for 10 minutes and then subjected to water washing and "ashed" to determine the remaining amounts of powder.

TABLE 2

| Fibers Post-spun Heated | | |
|---|---|---|
| | Water washed | Weight % Kaolin on fibers (average of 4 samples) |
| Example 4-1 | no | 3.4 |
| | Yes | 1.3 |
| Example 4-2 | no | 6.9 |
| | Yes | 2.7 |

Another set of samples were tested for blood clotting time. For reference, the control clotting time was 7.5 minutes, whereby the blood was brought to body temperature and allowed to clot without clotting agents present.

TABLE 3

| | Air washed | Weight % Kaolin Lost | Clotting time (min) |
|---|---|---|---|
| Example 4-1 | no | | 1.8 |
| | Yes | 17.6 | 1.5 |
| Example 4-2 | no | | 1.3 |
| Post heated | Yes | 6.3 | 1.7 |

Example 5

Chitosan

Figure 16:
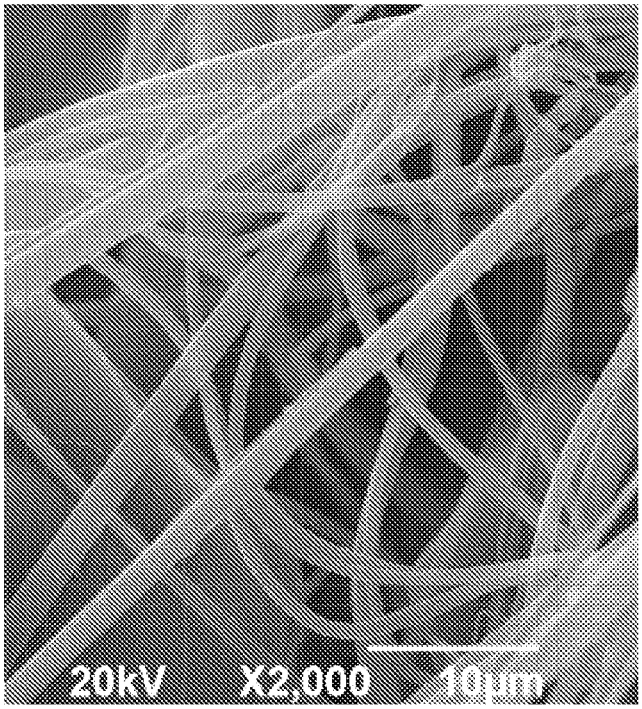
FIG. 16 is an SEM picture of fibers produced in Example 5.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 157 C and pressurized to 38 psig. The heated and pressurized mixture was forced through a 140 micron rated filter and then into the two-phase flow nozzle. Heated air was injected into the two-phase chamber at 220 C and 38 psig. A flow of air and chitosan powder at 105 C impinged upon the primary two-phase flow, thereby attaching the powder to the polymer mixture melt. A SEM of the fibers produced is shown in FIG. 16. The production rate was 1.72 g/min. The amount of attached chitosan powder was 10.1% by weight. The blood clotting time was measured to be 4.5 minutes. An observation was that chitosan absorbed the blood very well and created a gel although the time to clot was lengthy.

Example 6

Chitosan and Kaolin

Figure 17:
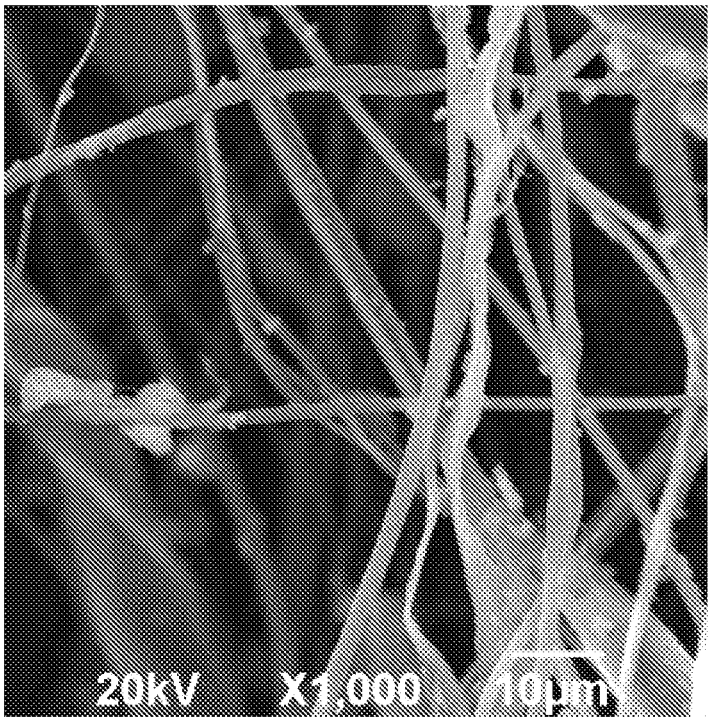
FIG. 17 is an SEM picture of fibers produced in Example 6.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 154 C and pressurized to 37-38 psig. The heated and pressurized mixture was forced through a 140 micron rated filter and then into the two-phase nozzle. Heated air was injected into the two-phase chamber at 218 C and 30-37 psig. A flow of air, chitosan powder, and kaolin powder at 76 C impinged upon the primary two-phase flow, thereby attaching the powders to the polymer mixture melt. The ratio of powders was: kaolin 75% and chitosan 25%. A SEM of the collected fibers is shown in FIG. 17. The production rate was 0.7-0.88 g/min. The amount of attached powder (chitosan and kaolin) was 17% by weight; chitosan at 14.5% and kaolin at 2.5%. The sample was water washed and amount of attached kaolin after washing was 0.9% and the amount of attached chitosan was found to be approximately unchanged at 14.5%.

TABLE 4

| Air washed | Powder Weight % Lost | Clotting time (min) |
|---|---|---|
| no | 1.8 | |
| Yes | 3.4 | 1.5 |

Air washing was observed to create a more "open" structure, thereby permitting the blood to flow more freely into the fibrous structure. Also, it was observed that the blood began clotting immediately and wetted out the sample due to the chitosan.

Example 7

⅓ mol Calcium Peroxide and ⅔ mol Citric Acid

Figure 18:
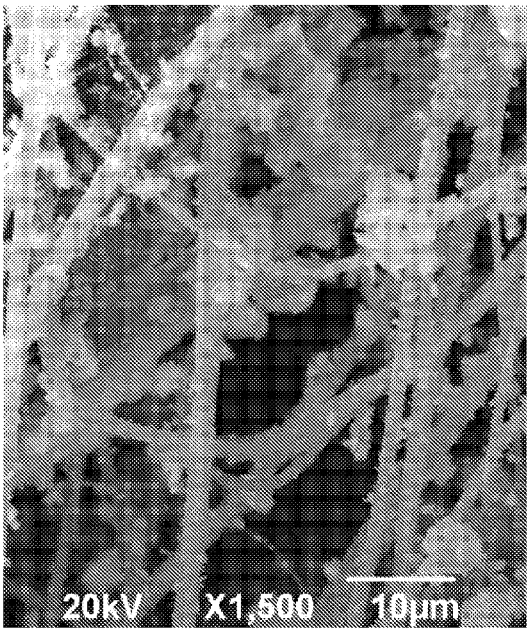
FIG. 18 is an SEM picture of fibers produced in Example 7.
Figure 19:
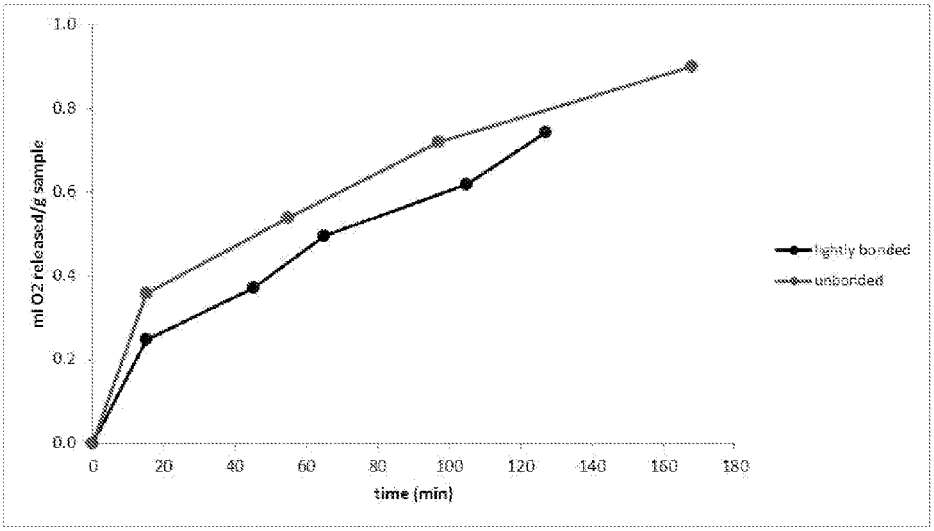
FIG. 19 shows the release of oxygen corresponding to Example 7.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 154 C and pressurized to 40 psig. The heated and pressurized polymer was forced through a 140 micron rated filter and then into the two-phase nozzle. Heated air was injected into the two-phase chamber at 228 C and 40 psig. A flow of air, ⅓ mol calcium peroxide powder, and ⅔ mol citric acid powder at 60 C was impinged upon the primary two-phase flow, thereby attaching the powders to the polymer mixture melt. The production rate was 0.71 g/min. The attachment of the powders to the fibers is shown in FIG. 18. The sample was saturated with water and the release rate of oxygen was measured (see FIG. 19.)

Example 8

Copper Oxide, Chitosan, and Reon

Figure 20:
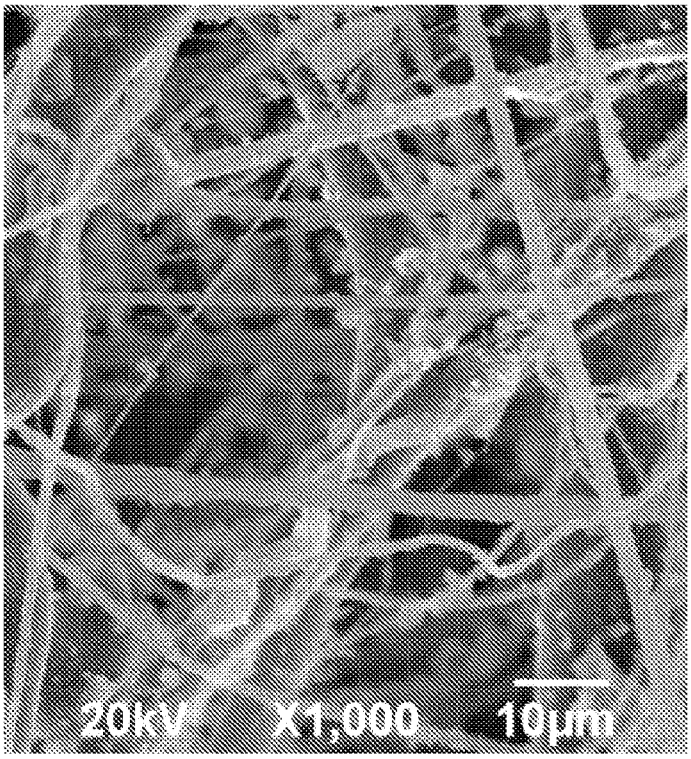
FIG. 20 is an SEM picture of fibers produced in Example 8.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 152 C and pressurized to 40 psig. The heated and pressurized polymer was forced through a 140 micron rated filter and then into the two-phase nozzle. Heated air was injected into the two-phase chamber at 212 C and 38 psig. A flow of air, Reon powder, copper oxide powder, and chitosan powder at 350 C was impinged upon the primary two-phase flow, thereby attaching the powders to the polymer mixture melt. The weight ratio of the powders was: Reon 25%, copper oxide 25%, and chitosan 50%. A SEM picture of the collected fibers is shown in FIG. 20. The production rate was 0.6 g/min.

Example 9

⅓ mol Calcium peroxide and ⅔ mol Citric acid; and chitosan

Figure 21:
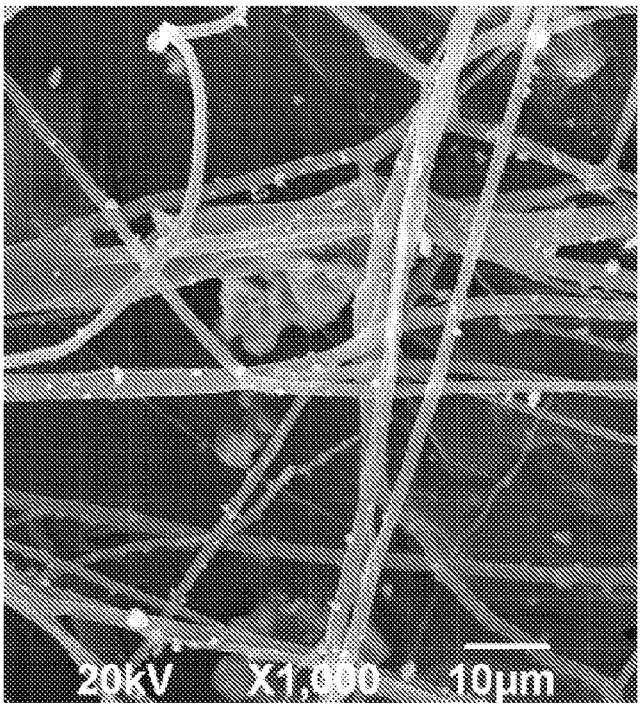
FIG. 21 is an SEM picture of fibers produced in Example 9.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 154 C and pressurized to 40 psig. The heated and pressurized polymer was forced through a 140 micron rated filter and then into the two-phase flow nozzle. Heated air was injected into the two-phase chamber at 228 C and 40 psig. A flow of air, ⅓ mol calcium peroxide powder, ⅔ mol citric acid powder, and chitosan powder at 60 C was impinged upon the primary two-phase flow, thereby attaching the powders to the polymer mixture melt. The weight ratio of the powders was: citric acid 51%, calcium peroxide 19%, and chitosan 25%. A SEM picture of the collected fibers is shown in FIG. 21. The production rate was 0.71 g/min.

Example 10

Kaolin, Chitosan, and Reon Vacuum Steamed

Figure 22:
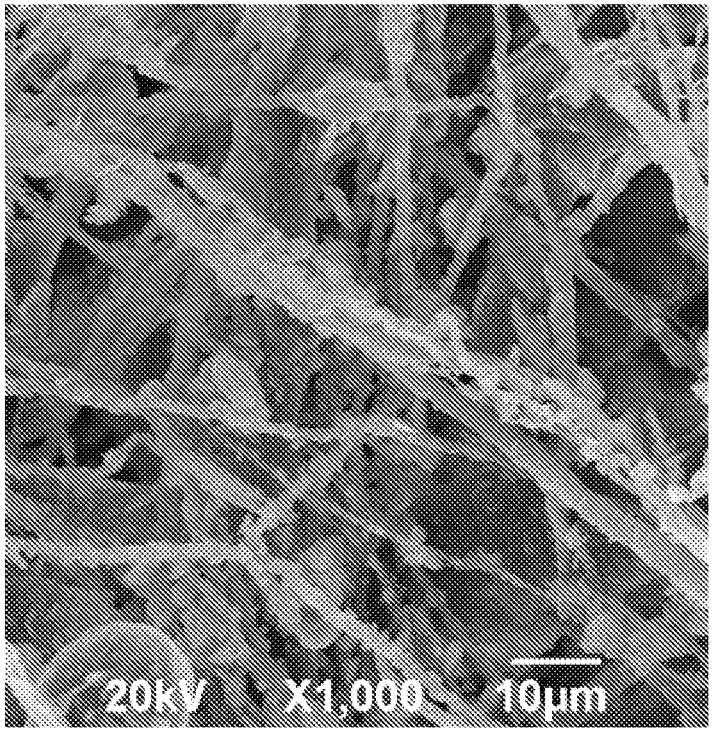
FIG. 22 is an SEM picture of fibers produced in Example 10.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 152 C and pressurized to 40 psig. The heated and pressurized polymer was forced through a 140 micron rated filter and then into the two-phase flow nozzle. Heated air was injected into the two-phase chamber at 212 C and 38 psig. A flow of air, Reon powder, kaolin powder, and chitosan powder at 350 C impinged upon the primary two-phase flow, thereby attaching the powders to the polymer mixture melt. The weight ratio of the powders was: Reon 40%, kaolin 50%, and chitosan 10%. The production rate was 0.6 g/min. After the sample was formed, a flow of steam was vacuumed through the material. This technique made the reon powder sticky thus forming more of a bond between the powders and the fibers. A SEM picture of the material is shown in FIG. 22.

Example 11

Kaolin, Chitosan, and Reon

Figure 23:
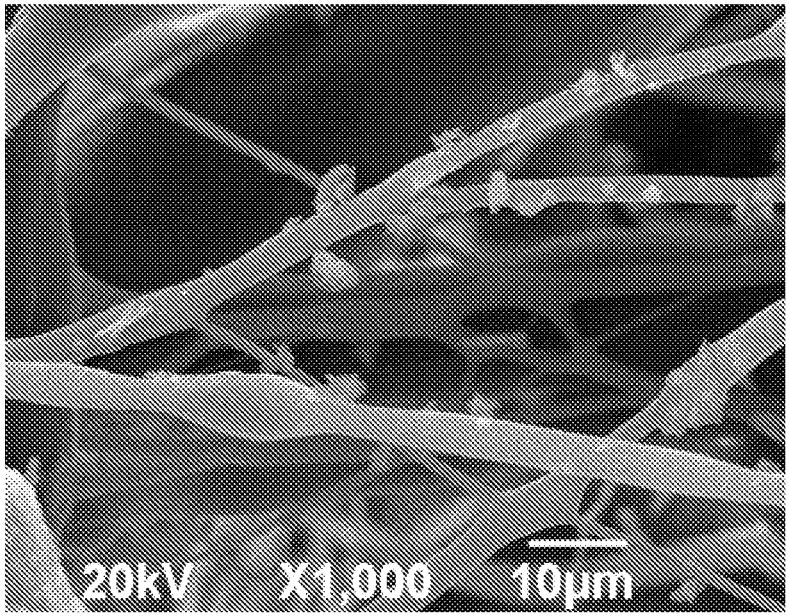
FIG. 23 is an SEM picture of fibers produced in Example 11.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 152 C and pressurized to 40 psig. The heated and pressurized polymer was forced through a 140 micron rated filter and then into the two-phase nozzle. Heated air was injected into the two-phase chamber at 212 C and 38 psig. A flow of air, Reon powder, kaolin powder, and chitosan powder at 350 C was impinged upon the primary two-phase flow, thereby attaching the powders to the polymer mixture melt. The weight ratio of the powders was: Reon 25%, copper oxide 25%, and chitosan 50%. A SEM picture of the collected fibers is shown in FIG. 23. The production rate was 0.6 g/min.

Example 12

Kaolin

Figure 24:
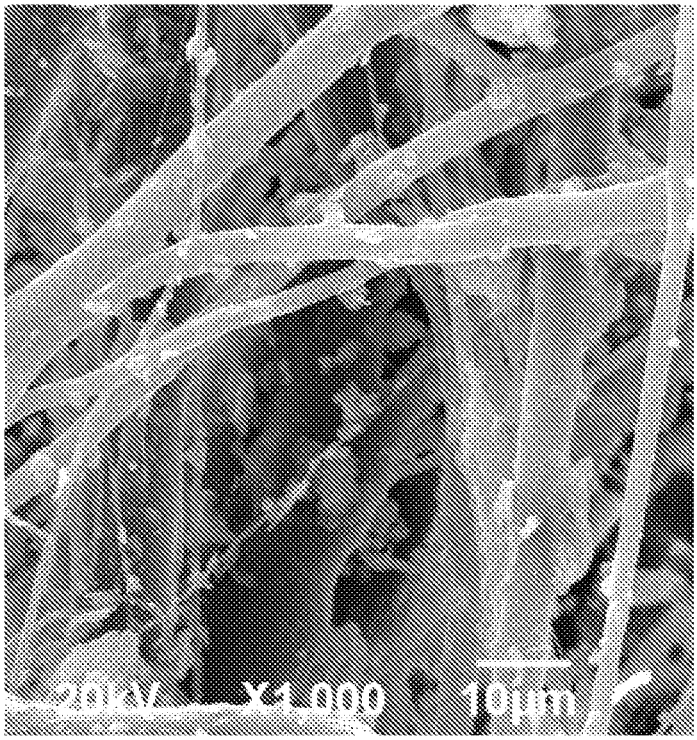
FIG. 24 is an SEM picture of fibers produced in Example 12.

A stainless steel reactor vessel (volume=0.5 l) was charged with 100 g of Capa 6100 polycaprolactone polymer (Perstorp), 30 g of Capa 6500 polycaprolactone polymer (Perstorp), 5 g of Capa 6800 (Perstop), and 0.5 g of Cocamidopropyl Betaine. The mixture was heated to 156 C and pressurized to 50 psig. The heated and pressurized mixture was forced through a 140 micron rated filter and then into the two-phase nozzle. Heated air was injected into the two-phase chamber at 197 C and 50 psig. A flow of heated air and Kaolin powder was impinged upon the primary two-phase flow, thereby attaching powder to the polymer mixture melt. A SEM picture of the collected fibers is shown in FIG. 24. The flowrate was 1.89 g/min.

Example 13

Figure 25:
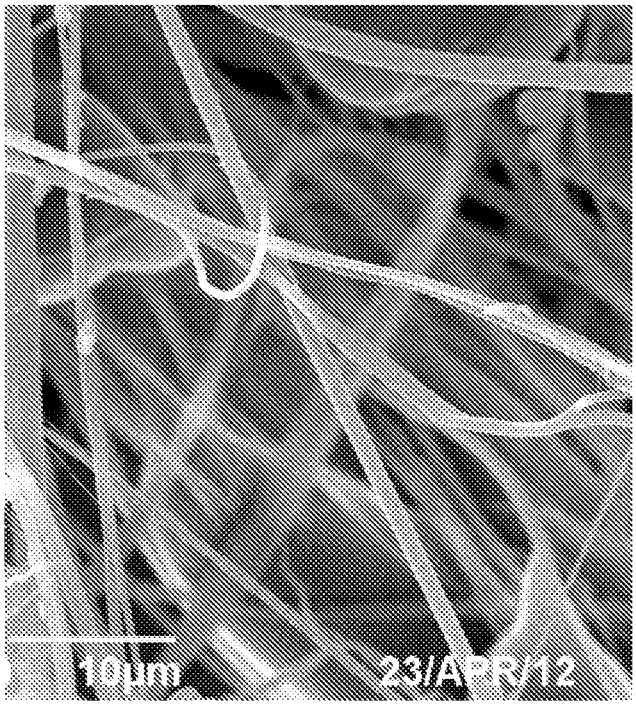
FIG. 25 is an SEM picture of fibers produced in Example 13.

A stainless steel reactor vessel (volume=0.5 l) was charged with 100 g of Capa 6100 polycaprolactone polymer (Perstorp), 30 g of Capa 6500 polycaprolactone polymer (Perstorp), 5 g of Capa 6800 (Perstop), and 0.5 g of Cocamidopropyl Betaine. The mixture was heated to 130 C and pressurized to 42 psig. The heated and pressurized mixture was forced through a 140 micron rated filter and then into the two-phase nozzle . Heated air was injected into the two-phase chamber at 207 C and 38 psig. Heated air was impinged onto the 2 phase flow at 400 C. A SEM picture of the collected fibers is shown in FIG. 25. The flowrate of fibers was 0.33 g/min.

Example 14

Figure 26:
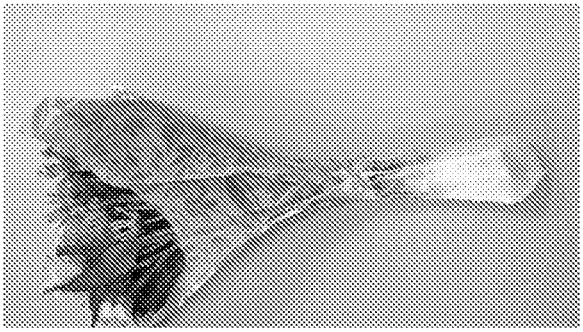
FIG. 26 is a photograph materials produced in Example 14.
Figure 27:
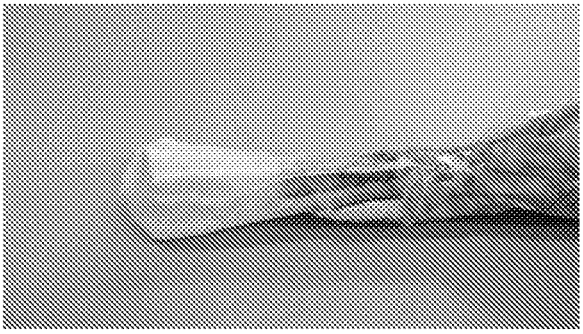
FIG. 27 is a photograph of materials produced in Example 14.
Figure 28:
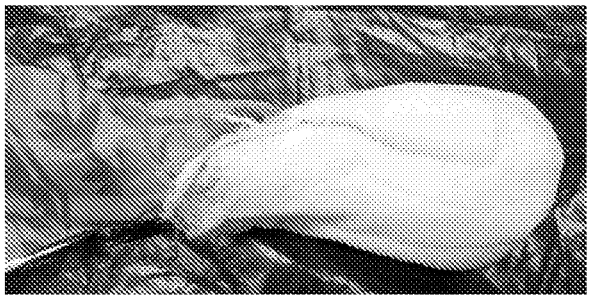
FIG. 28 is a photograph of materials produced in Example 14.

A stainless steel reactor vessel (volume=0.5 l) was charged with 50 g of NatureWorks® PLA polymer 6302D. The polymer was heated to 174 C and pressurized to 42 psig. The heated and pressurized polymer was forced through a 140 micron rated filter and then into the two-phase nozzle. Heated air was injected into the two-phase chamber at 278 C and 50 psig. A flow of heated air at approximately 350 C and powder mixture impinged upon the primary two-phase flow, thereby attaching the powder mixture to the polymer mixture melt. The powder mixture was 95% Reon™ and 2.5% Chrysal Clear Professional 2. The free jet carrying the PLA fibers and the attached Reon™ and Chrysal Clear Professional 2 powder mixture impinged upon the stems of a bouquet of cut flowers. The flowers were rotated slowly under the free jet allowing the fibers and attached powders to form a layer of material for transporting the bouquet. The material covered the cut ends of the stems and a distance of about 6 cm along the stems from the cut ends toward the flowers. The bouquet of flowers with the material is shown in FIGS. 26, 27, and 28.

Example 15

Tissue Scaffold

Figure 29:
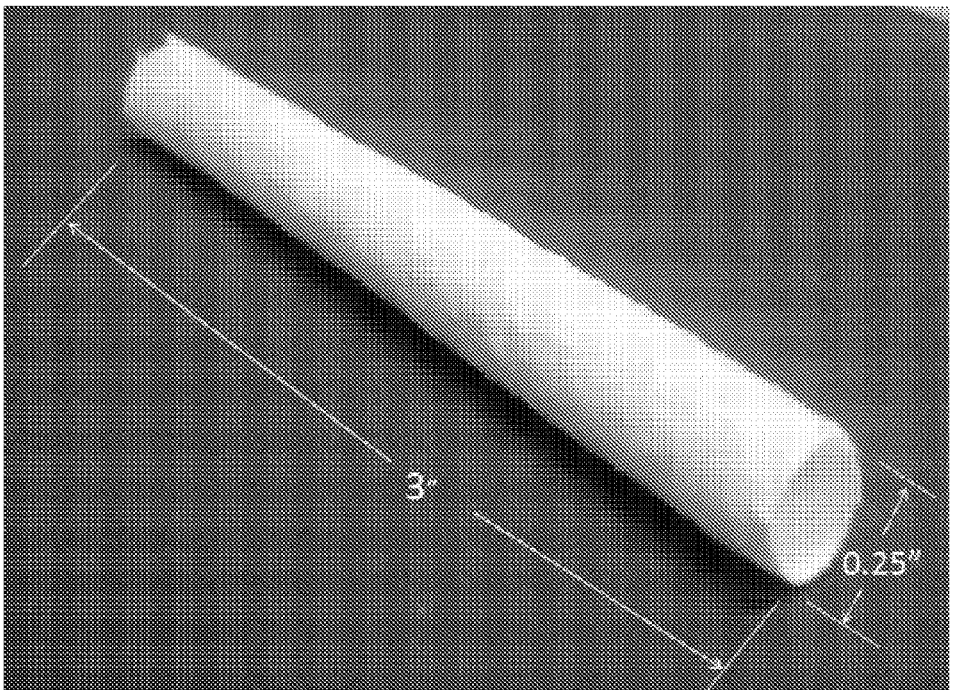
FIG. 29 is a tubular structure produced in Example 15.

A stainless steel reactor vessel (volume=0.5 l) was charged with 105 g of Capa 6100 polycaprolactone polymer (Perstorp), 45 g of Capa 6500 polycaprolactone polymer (Perstorp), and 0.5 g of Cocamidopropyl Betaine. The mixture was heated to 150 C and pressurized to 40 psig. The heated and pressurized mixture was forced through a 140 micron rated filter and then into the two-phase nozzle as shown in FIG. 2. Heated air was injected into the two-phase chamber at 210 C and 38 psig. Flowrate was 0.6 g/min. The issuing fibers were impinged upon a rotating circular plastic drinking straw at a distance of about 8 to 10 inches. The fibers were allowed to collect for about 4 to 4 minutes resulting in the formation of a tubular structure as shown in FIG. 29. The structure would be useful as a tissue engineering scaffold.

Example 16

A stainless steel reactor vessel (volume=0.5 l) was charged with 70 g of Capa 6100 polycaprolactone polymer (Perstorp), 30 g of Capa 6500 polycaprolactone polymer (Perstorp), 25 g of Natureworks polylatic acid polymer (PLA grade 6302D), and 2.5 g kaolin powder. The mixture was heated to 165 C and pressurized to 40 psig. The heated and pressurized mixture was forced through a 140 micron rated filter and then into the two-phase nozzle as shown in FIG. 2. Heated air was injected into the two-phase chamber at 265 C and 50 psig. The fibers produced were collected on a screen 12-28 inches away.

Example 17

A stainless steel reactor vessel (volume=0.5 l) was charged with 105 g of Capa 6100 polycaprolactone polymer (Perstorp), 37.5 g of Capa 6500 polycaprolactone polymer (Perstorp), 7.5 g of Capa 6800 polycaprolactone polymer (Perstorp), and 0.75 g of cocamidopropyl betaine. The mixture was heated to 150 C and pressurized to 50 psig. The heated and pressurized mixture was forced through a 140 micron rated filter and then into the two-phase nozzle as shown in FIG. 2. Heated air was injected into the two-phase chamber at 232 C and 52 psig. The fibers produced were collected on a screen 12-28 inches away.

Example 18

Figure 30:
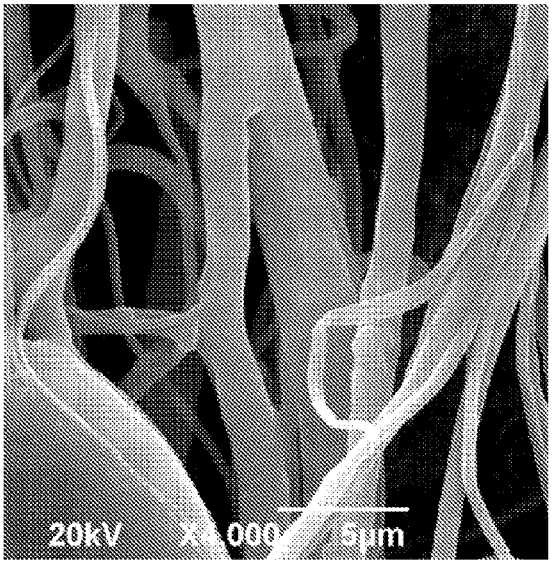
FIG. 30 is an SEM picture of fibers produced in Example 18.

A stainless steel reactor vessel (volume=0.5 l) was charged with 105 g of Capa 6100 polycaprolactone polymer (Perstorp), 37.5 g of Capa 6500 polycaprolactone polymer (Perstorp), 7.5 g of Capa 6800 polycaprolactone polymer (Perstorp), 0.75 g of cocamidopropyl betaine, and 1.5 g sodium percarbonate. The mixture was heated to 80 C and pressurized to 40 psig. The heated and pressurized mixture was forced through a 140 micron rated filter and then into the two-phase nozzle as shown in FIG. 2. Heated air was injected into the two-phase chamber at 240 C and 50 psig. The fibers produced were collected on a screen 12-28 inches away. A SEM picture of the fibers collected is shown in FIG. 30.

Example 19

Figure 31:
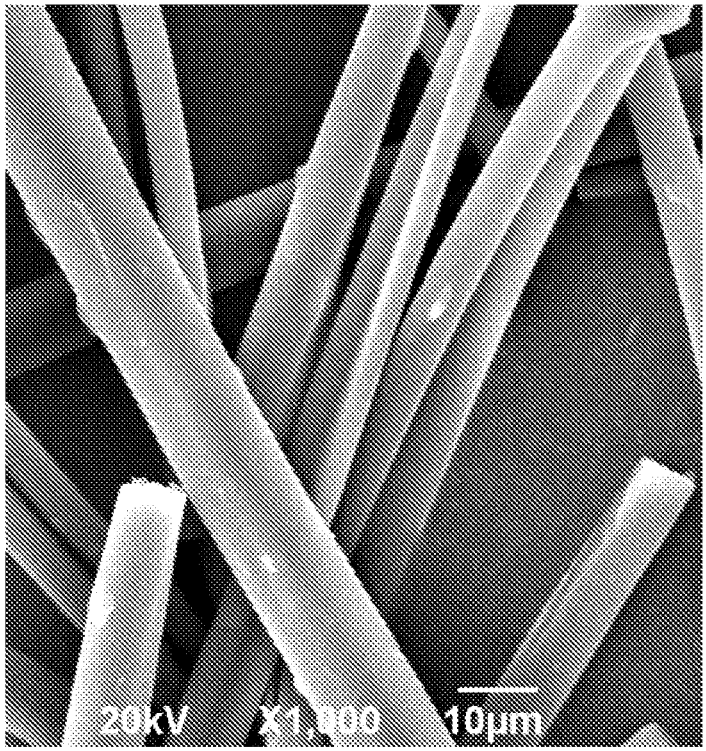
FIG. 31 is an SEM picture of fibers produced in Example 19.

A stainless steel reactor vessel (volume=0.5 l) was charged with 25 g of Capa 6100 polycaprolactone polymer (Perstorp), 25 g poly (2-ethyl 2 oxazoline) polymer, and 2.75 g kaolin powder. The mixture was heated to 154 C and pressurized to 32 psig. The heated and pressurized mixture was forced through a 140 micron rated filter and then into the two-phase nozzle as shown in FIG. 2. Heated air was injected into the two-phase chamber at 243 C and 40 psig. The fibers produced were collected on a screen 12-28 inches away. A SEM picture of the fibers collected is shown in FIG. 31.

Example 20

A stainless steel reactor vessel (volume=0.5 l) was charged with 25 g of Capa 6100 polycaprolactone polymer (Perstorp), 27.3 g of Capa 6500 polycaprolactone polymer (Perstorp), 10 g poly (2-ethyl 2 oxazoline) polymer, and 5 g water. The mixture was heated to 151 C and pressurized to 32 psig. The heated and pressurized mixture was forced through a 140 micron rated filter and then into the two-phase nozzle as shown in FIG. 2. Heated air was injected into the two-phase chamber at 222 C and 40 psig. The fibers produced were collected on a screen 12-28 inches away.

Example 21

Figure 32:
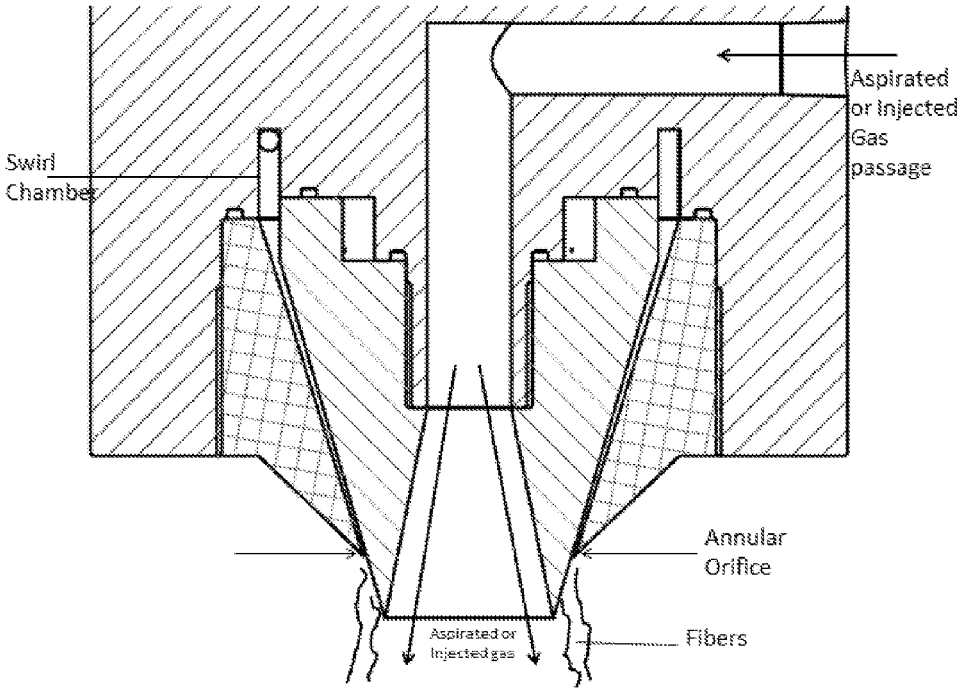
FIG. 32 is a cross-section of a two-phase flow nozzle according to the disclosure in Example 21.

A stainless steel reactor vessel (volume=0.5 l) was charged with 105 g of Capa 6100 polycaprolactone polymer (Perstorp), 45 g of Capa 6500 polycaprolactone polymer (Perstorp), The mixture was heated to 160 C and pressurized to 60 psig. The heated and pressurized mixture was forced through a 140 micron rated filter and then into the two-phase nozzle as shown in FIG. 32. Heated air was injected into the two-phase chamber at 245 C and 80 psig. The fiber flowrate was 0.141 g/min. The fibers produced were collected on a moving scrim of Reemay® as it passed over a vacuum box. The exit of the two-phase nozzle was 18 inches from the collecting surface. The machine-direction (MD) uniformity of the collected sheet material was measured by weighing 0.5 inch squares in lanes in the MD. Three lanes were measured, each with 14 squares. The sample uniformity index, UI, was calculated to be 5.6 (see definition of UI.)

Example 22

Filter Media

Figure 42:
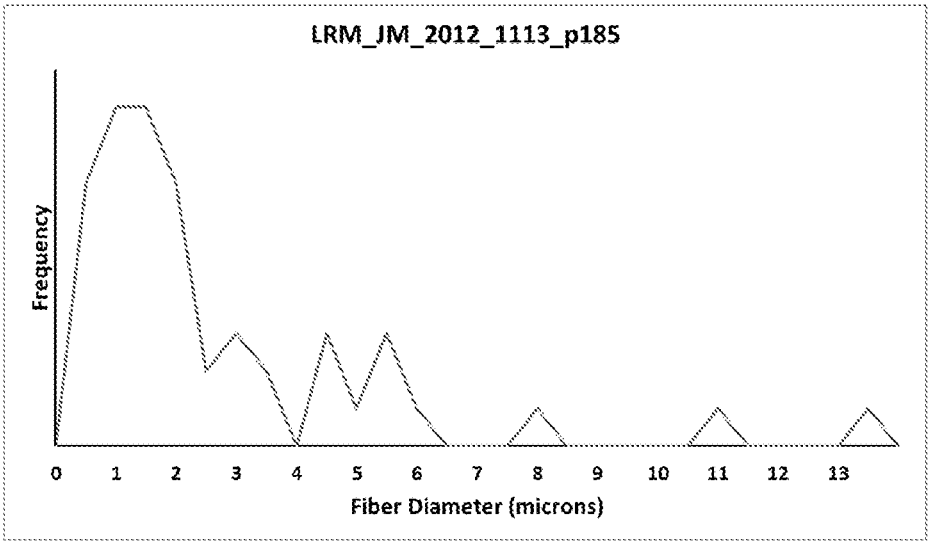
FIG. 42 illustrates the distribution of fiber fine diameters in sample coform materials.

A stainless steel reactor vessel (volume=0.5 l) was charged with 200 g of polypropylene (Aldrich 428116) and 0.2 g of Westin 619 and 0.2 g of BHT. The mixture was heated to 197 C and pressurized to 15 psig. The heated and pressurized mixture was forced through a 140 micron rated filter and then fed into the nozzle. The heated polymer mixture was injected into a swirl chamber through 8 orifices, each with diameter=0.51 mm. Heated air at 231 C and 50 psig was injected into a swirl chamber by two orifices, each with diameter=3.18 mm. The diameter of the nozzle exit gap was 11.5 cm and gap width was approximately 0.53 mm. The nozzle was placed approximately 5 cm from a perforated plate collecting surface. Reemay scrim was pulled across the collecting surface with a vacuum flow pulled through the Reemay and under the jet being issued through the nozzle exit gap. The material shown in SEM pictures in FIGS. 37, 38, 39, 40 and 41 were obtained. The fiber size distribution contained a wide spread of fiber sizes, from submicron to about 13 microns in shown in FIG. 42. The material is "lofty" and has an approximate percent porosity of 85, a basis weight of approximately 55 gsm, and a thickness of approximately 0.43 mm.

Example 23

Activated Carbon Powder

A stainless steel reactor vessel (volume=0.5 l) was charged with 180 g of polypropylene (Aldrich 428116) and 5 g of mineral oil and 5 g of panalane H-300E (Lipo Chemicals). The mixture was heated to 206 C and pressurized to 40 psig. The heated and pressurized mixture was forced through a 140 micron rated filter and then fed into the nozzle. The heated polymer mixture was injected into a swirl chamber through 8 orifices, each with diameter=0.51 mm. Heated air at 260 C and 60 psig was injected into a swirl chamber by two orifices, each with diameter=3.18 mm. The diameter of the nozzle exit gap was 2.54 cm and gap width was approximately 0.53 mm.

Figure 43:
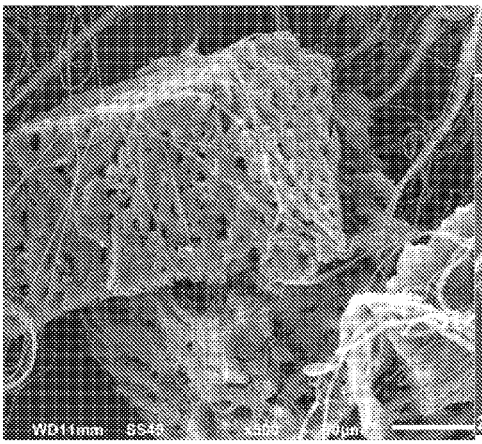
FIGS. 43, 44 and 45 are SEM pictures of coform materials made from fine fibers and activated carbon powder.
Figure 44:
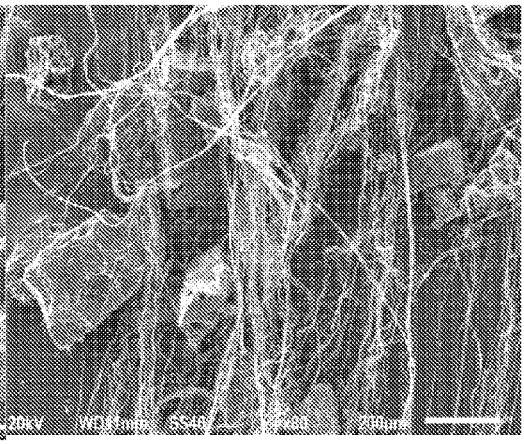
Figure 45:
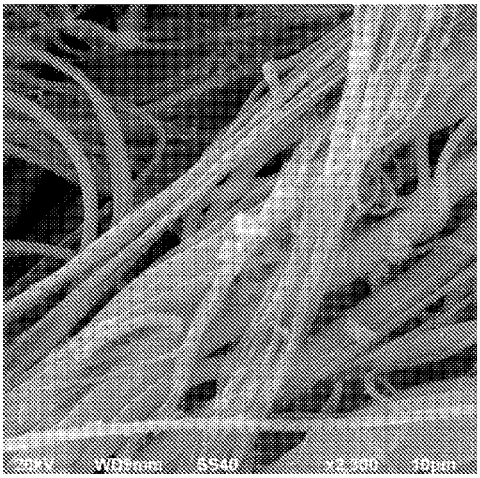

The nozzle was placed approximately 33 cm from a perforated plate collecting surface. Reemay scrim was pulled across the collecting surface with a vacuum flow pulled through the Reemay and under the jet being issued through the nozzle exit gap. Activated carbon powder (Fisherbrand® 05-690-A, 50-200 mesh) was fed into the nozzle by a screw feeder (Schenck Accurate 100 with 1.9 cm diameter screw) at a setting of 200. The collected material had a basis weight of approximately 41.5 gsm. The fiber portion of the material basis weight was 7.5 gsm and the powder portion of the basis weight was 34 gsm. Scanning electron microscope (SEM) pictures of the collected material is shown in FIGS. 43, 44, and 45.

Example 24

Superabsorbent Polymer Powder

Figure 46:
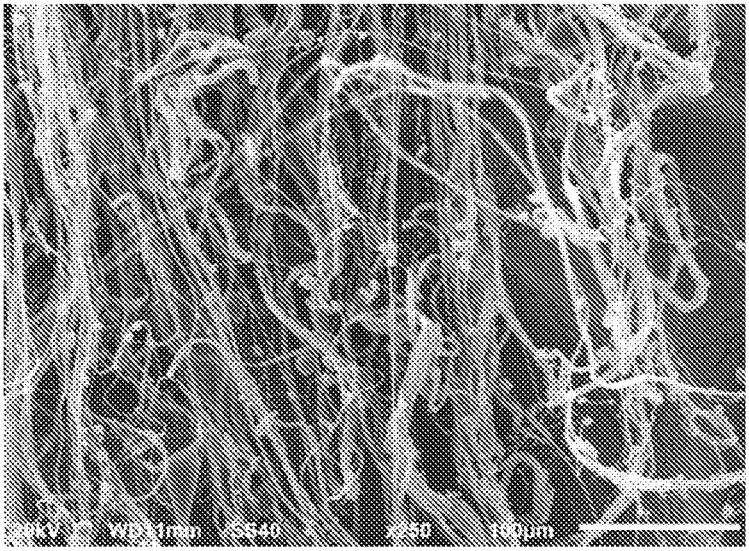
FIGS. 46 and 47 are SEM pictures of coform materials made from of fine fibers and superabsorbent particles.
Figure 47:
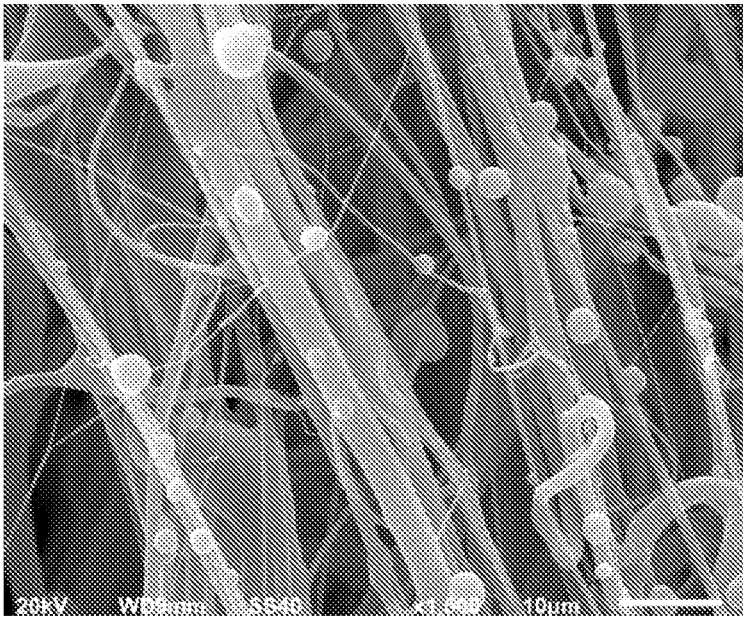

A stainless steel reactor vessel (volume=0.5 l) was charged with 196 g of polypropylene (Aldrich 428116) and 4 g polypropylene (Marco Polo) and 4 g of panalane H-300E (Lipo Chemicals). The mixture was heated to 211 C and pressurized to 40 psig. The heated and pressurized mixture was forced through a 140 micron rated filter and then fed into the nozzle. The heated polymer mixture was injected into a swirl chamber through 8 orifices, each with diameter=0.51 mm. Heated air at 258 C and 60 psig was injected into a swirl chamber by two orifices, each with diameter=3.18 mm. The diameter of the nozzle exit gap was 2.54 cm and gap width was approximately 0.53 mm. The nozzle was placed approximately 25.4 cm from a perforated plate collecting surface. Reemay scrim was pulled across the collecting surface with a vacuum flow pulled through the Reemay and under the jet being issued through the nozzle exit gap. Superabsorbent polymer powder was fed into the nozzle by a screw feeder (Schenck Accurate 100 with 1.9 cm diameter screw) at a setting of 999. The collected material had a basis weight of approximately 123.5 gsm. The fiber portion of the material basis weight was 45 gsm and the powder portion of the basis weight was 78.5 gsm. Scanning electron microscope (SEM) pictures of the collected material is shown in FIGS. 46 and 47.

What is claimed is:

1. A process for producing a coform fibrous material comprising a) supplying a fiber forming first stream comprising a first phase comprising a polymer melt and a second phase comprising a pressurized gas to a two-phase flow nozzle;

b) supplying a separate second stream containing at least one secondary material to the two-phase flow nozzle;

c) impinging the second stream upon and into the first stream to mix the first and second streams into a combined stream;

d) depositing the combined stream onto a receiving surface as a fibrous web wherein the secondary material is dispersed within the fibrous web.

2. The process of claim 1 wherein the second stream is substantially enveloped and contained within the first stream.

3. The process of claim 1 wherein the at least one secondary material comprises nanoparticles.

4. The process of claim 1 wherein the second stream is aspirated into the two-phase flow nozzle.

5. The process of claim 1 wherein the secondary material is anchored in the coform fibrous web without adhesives or binders.

6. The process of claim 1 wherein the two phase nozzle has an annular configuration.

7. The process of claim 1 wherein the two-phase nozzle has a substantially linear configuration.

* * * * *